US011409247B2

(12) United States Patent
Matsuoh

(10) Patent No.: US 11,409,247 B2
(45) Date of Patent: Aug. 9, 2022

(54) ANALOG ELECTRONIC WATCH SYSTEM AND ANALOG ELECTRONIC WATCH

(71) Applicant: CITIZEN WATCH CO., LTD., Nishitokyo (JP)

(72) Inventor: Daisuke Matsuoh, Nishitokyo (JP)

(73) Assignee: CITIZEN WATCH CO., LTD., Nishitokyo (JP)

( * ) Notice: Subject to any disclaimer, the term of this patent is extended or adjusted under 35 U.S.C. 154(b) by 683 days.

(21) Appl. No.: 16/255,290

(22) Filed: Jan. 23, 2019

(65) Prior Publication Data

US 2019/0227497 A1 Jul. 25, 2019

(30) Foreign Application Priority Data

Jan. 24, 2018 (JP) ..... JP2018-009768
Dec. 28, 2018 (JP) ..... JP2018-247713

(51) Int. Cl.
*G04G 5/00* (2013.01)
*G04R 60/14* (2013.01)
*G04R 20/26* (2013.01)

(52) U.S. Cl.
CPC ..... *G04R 60/14* (2013.01); *G04R 20/26* (2013.01); *G04G 5/00* (2013.01)

(58) Field of Classification Search
CPC ..... G04G 5/00; G04G 21/00; G04C 3/146; G04R 20/26; G04R 60/14
See application file for complete search history.

(56) References Cited

U.S. PATENT DOCUMENTS 9,001,625 B2 * 4/2015 Essery ..... G04G 21/04 368/46
9,989,925 B2 * 6/2018 Wautier ..... G04R 20/30
10,095,189 B2 * 10/2018 Masserot ..... G04C 3/146
2005/0105401 A1 5/2005 Akahane et al.
2015/0362893 A1 * 12/2015 Masserot ..... G04C 3/146 368/4
2018/0188894 A1 * 7/2018 Feinstein ..... G04G 21/08
2018/0227754 A1 * 8/2018 Paez Velazquez ..... G06F 21/32

FOREIGN PATENT DOCUMENTS

JP 4200835 B2 12/2008

* cited by examiner

*Primary Examiner* — Sean Kayes
(74) *Attorney, Agent, or Firm* — Sughrue Mion, PLLC

(57) ABSTRACT

In an analog electronic watch system, a terminal equipment detects current display positions of hands in an image of the hands and a dial plate, and generates current display time information based on the current display positions. An analog electronic watch corrects the display positions of the hands based on the display time information. The terminal equipment at least acquires hand identification information including hand shape information about a shape of the hand of the analog electronic watch based on watch identification information transmitted from the analog electronic watch. The terminal equipment detects the current display positions based on the hand identification information, and transmits display time information based on the current display positions to the analog electronic watch.

15 Claims, 15 Drawing Sheets

ANALOG ELECTRONIC WATCH SYSTEM AND ANALOG ELECTRONIC WATCH

CROSS-REFERENCE TO RELATED APPLICATION(S)

The present application claims priority to and incorporates by reference the entire contents of Japanese Patent Application No. 2018-009768 filed in Japan on Jan. 24, 2018 and Japanese Patent Application No. 2018-247713 filed in Japan on Dec. 28, 2018.

BACKGROUND OF THE INVENTION

1. Field of the Invention

The present invention relates to an analog electronic watch system and an analog electronic watch.

2. Description of the Related Art

There has been developed an analog electronic watch that can transmit/receive information such as time information about a time to/from terminal equipment owned by a user through wireless communication. The analog electronic watch rotates a group of hands such as a second hand, a minute hand, an hour hand, and a date plate by a step motor to arrange the group of hands at display positions based on an internal time so that a user can recognize a current time.

The group of hands of the analog electronic watch may be shifted due to various external factors. In a case in which the group of hands are shifted, a current internal time is shifted from a current display time that is based on current display positions of the group of hands. Thus, the analog electronic watch has a correction function for the display time. In the related art, in a case of correcting the display time, the group of hands are rotated from the current display positions to reference positions based on positional information of the group of hands. In a case of manual correction performed by the user, when display time correction is started by an instruction from the user, current display position information is compared with reference position information corresponding to the reference positions, the group of hands are rotated to display positions based on the reference position information, an operation unit of the analog electronic watch is operated, the group of hands are adjusted to be at the reference positions when the group of hands are shifted from the reference positions, and the group of hands are rotated based on an internal time of the watch by an instruction from the user. Similarly, in a case of automatic correction performed by terminal equipment, the group of hands are rotated to the display positions based on the reference position information by an instruction from the user, a dial plate including the group of hands is imaged by the user with the terminal equipment, the current display positions of the group of hands are detected in the generated image, correction time information is transmitted to the analog electronic watch when it is determined that the group of hands are shifted from the reference positions, the analog electronic watch that has received the display time correction information automatically adjusts the group of hands to be at the reference positions based on the correction time information, and the group of hands are rotated based on the internal time of the watch by an instruction from the user (refer to Japanese Patent No. 4200835).

To detect current display positions of the group of hands in the generated image, an exterior case, a dial plate, a hand, and the like are extracted from the image. However, a shape, a color, and the like thereof are different depending on a type and a manufacture year of the analog electronic watch, so that the current display positions of the group of hands are detected from the entire image for any analog electronic watch.

SUMMARY OF THE INVENTION

The present invention is made in view of such a situation, and provides an analog electronic watch system and an analog electronic watch that can improve detection accuracy for current display positions of hands with respect to a dial plate in an image of the hands and the dial plate.

In order to solve the above mentioned problem and achieve the object, an analog electronic watch system according to one aspect of the present invention includes an analog electronic watch that includes at least one hand configured to rotate on a dial plate, and a watch-side communication unit configured to be able to at least receive time information about a time and transmit watch identification information from and to an outside; and a terminal equipment that includes a terminal-side communication unit configured to be able to at least transmit the time information about a time and receive the watch identification information to and from the outside, an imaging unit configured to image the dial plate, and generate an image of the hand and the dial plate including an image corresponding to the hand and the dial plate, and a terminal-side controller configured to detect a current display position of the hand in the image of the hand and the dial plate, and generate display time information based on the current display position, wherein the terminal-side controller acquires hand identification information including at least hand shape information about a shape of the hand of the analog electronic watch based on the watch identification information, detects the current display position based on the image of the hand and the dial plate and the hand identification information, and transmits at least the display time information based on the current display position to the watch-side communication unit, and the analog electronic watch corrects the display position of the hand based on the display time information.

In order to solve the above mentioned problem and achieve the object, an analog electronic watch according to another aspect of the present invention capable of at least receiving time information about a time from an outside, includes at least one hand configured to rotate on a dial plate; and a watch-side communication unit configured to be able to transmit watch identification information including hand shape information about a shape of the hand, wherein the analog electronic watch detects a current display position based on the watch identification information and an image of the hand and the dial plate including an image corresponding to the hand and the dial plate, receives display time information from a terminal equipment that generates the display time information by the current display position, and corrects the display position of the hand based on the display time information.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes the present invention in detail with reference to the drawings. The present invention is not limited to the following embodiments. Components according to the embodiments described below include a component that is easily conceivable by those skilled in the art or a component that is substantially the same.

First Embodiment

Figure 1:
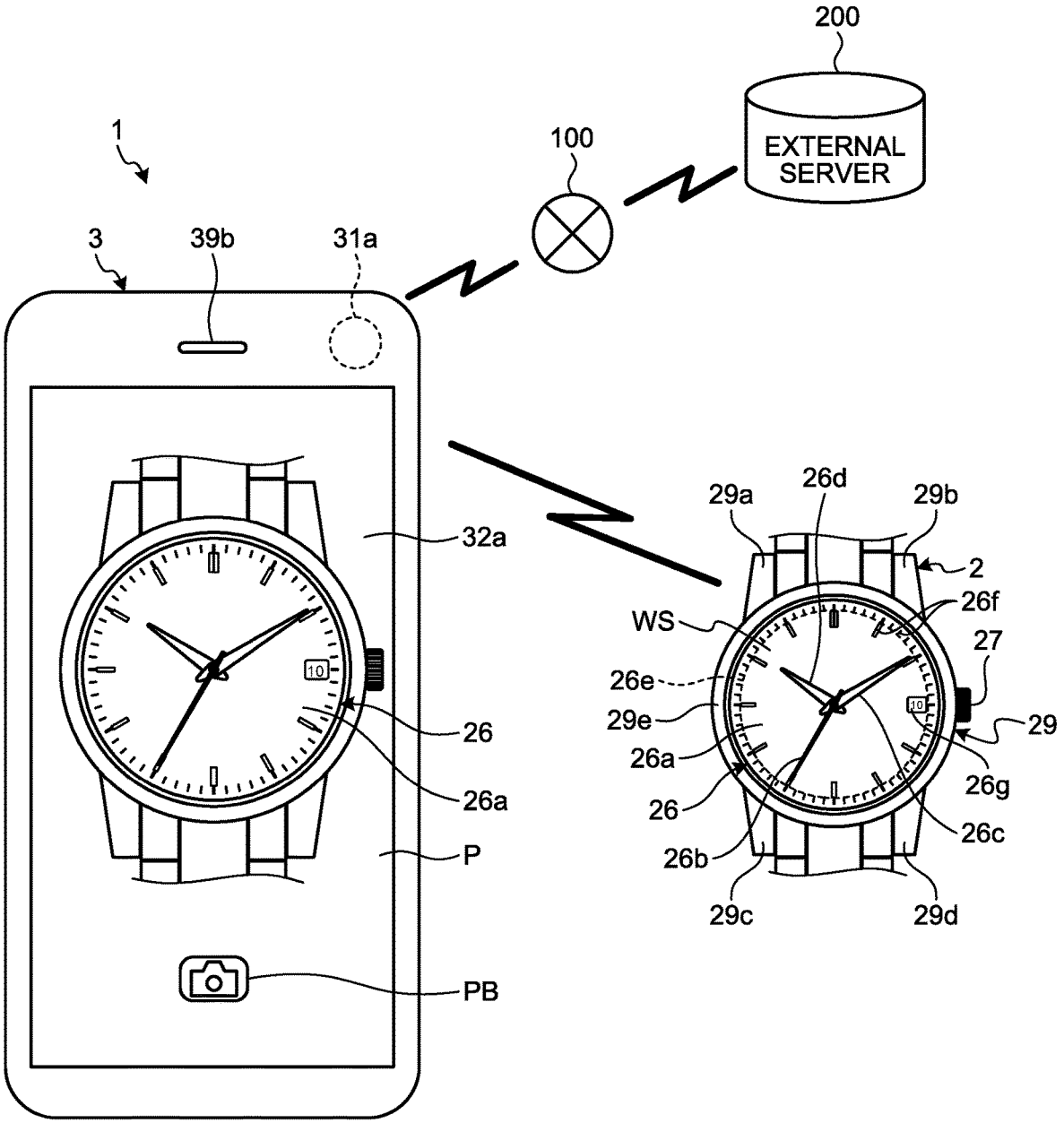
FIG. 1 is an entire configuration diagram of an analog electronic watch system according to an embodiment.
Figure 2:
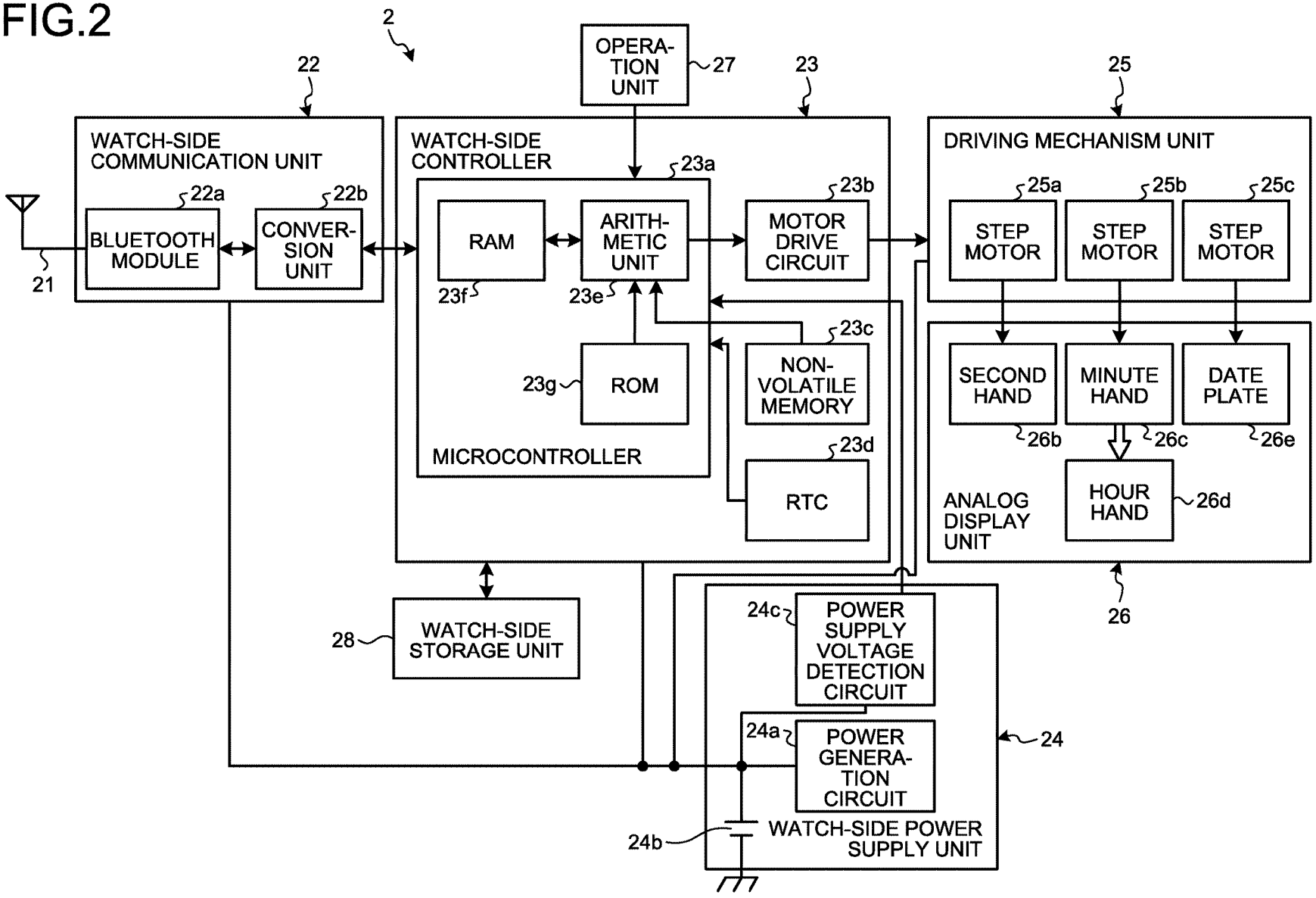
FIG. 2 is a block diagram of an analog electronic watch according to the embodiment.
Figure 3:
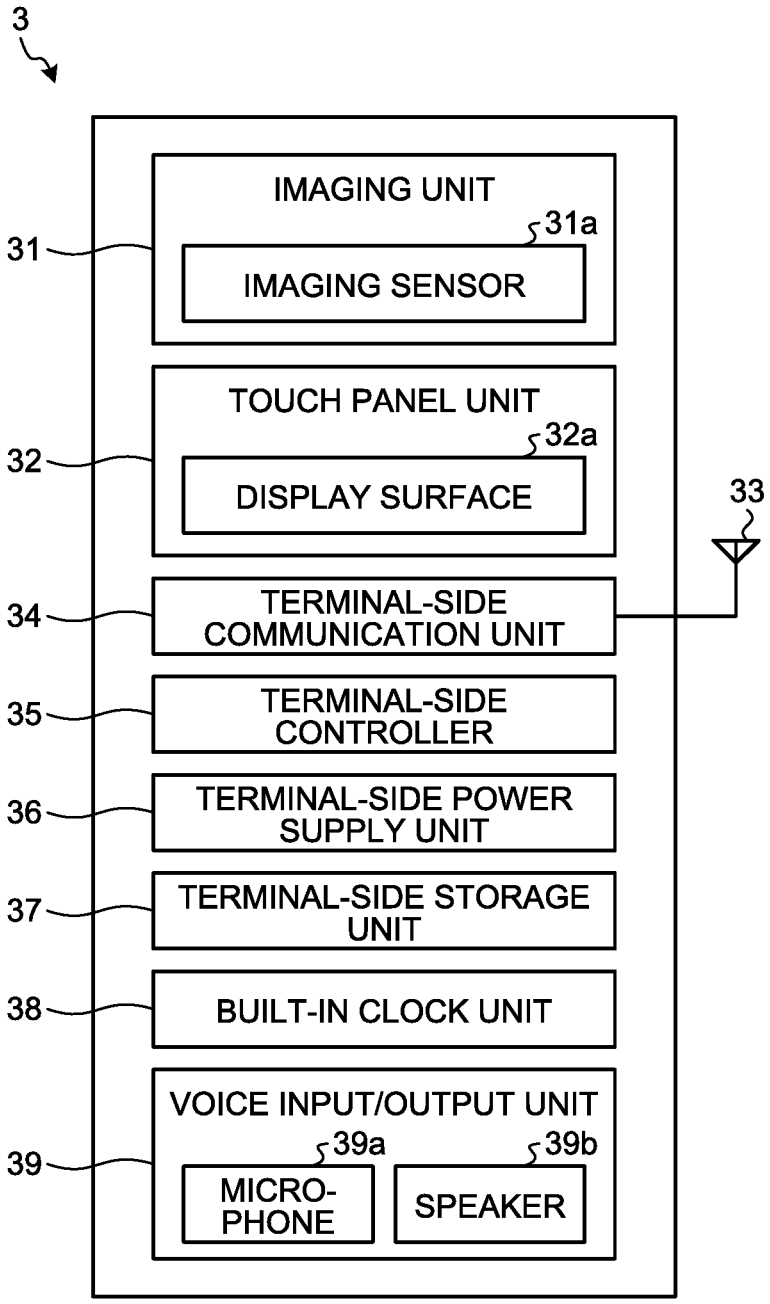
FIG. 3 is a block diagram of terminal equipment according to the embodiment.
Figure 4:
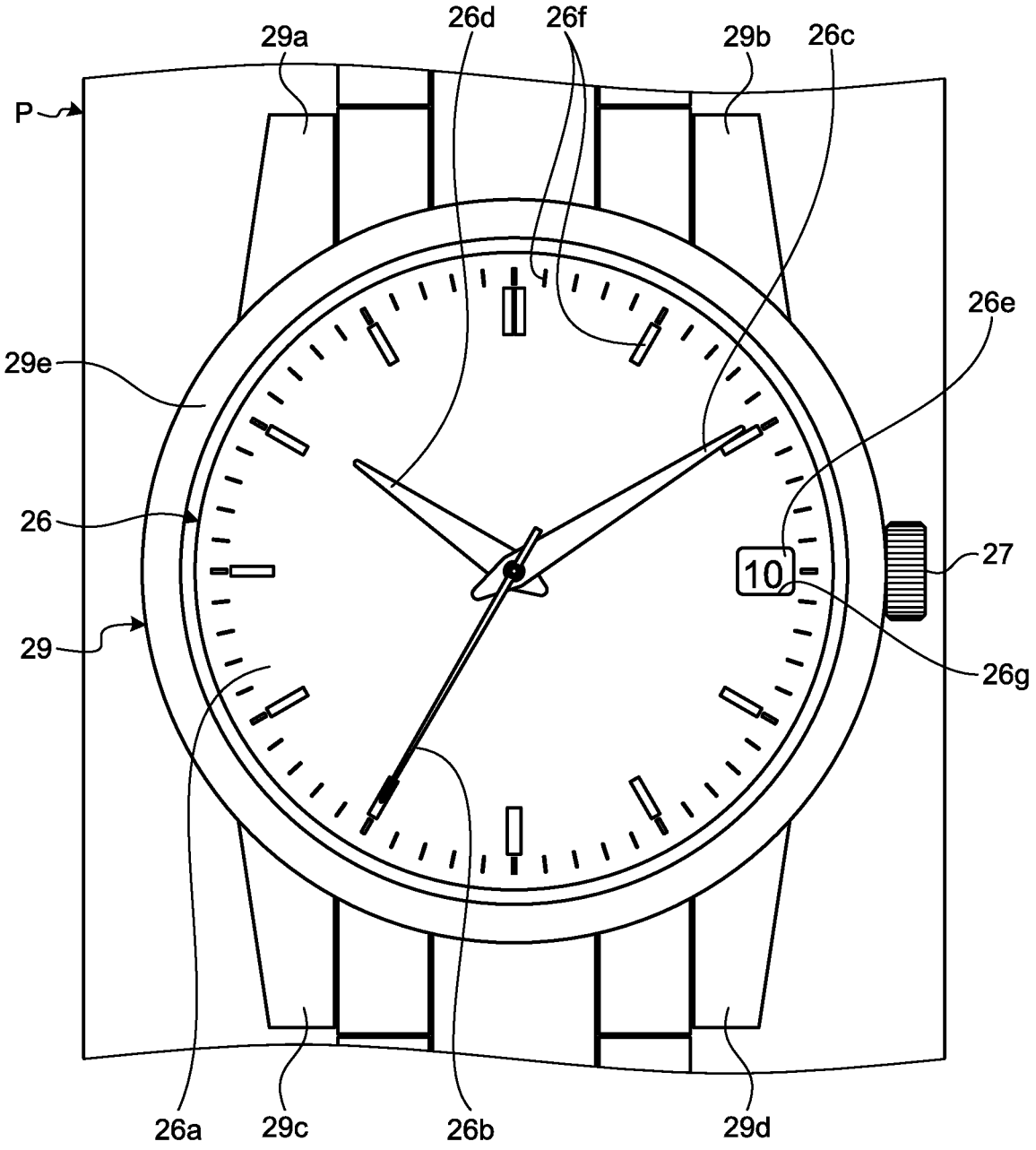
FIG. 4 is a diagram illustrating an image of hands and a dial plate taken by the terminal equipment.

FIG. 1 is an entire configuration diagram of an analog electronic watch system according to an embodiment. FIG. 2 is a block diagram of the analog electronic watch according to the embodiment. FIG. 3 is a block diagram of terminal equipment according to the embodiment. FIG. 4 is a diagram illustrating an image of hands and a dial plate taken by the terminal equipment.

An analog electronic watch system 1 according to a first embodiment includes an analog electronic watch 2 and terminal equipment 3. In the analog electronic watch system 1, time information about a time is exchanged between the analog electronic watch 2 and the terminal equipment 3 to perform display time correction for the analog electronic watch 2. The analog electronic watch system 1 described in the present embodiment uses, as communication means between the analog electronic watch 2 and the terminal equipment 3, Bluetooth (registered trademark) as short-range wireless communication means, but the communication means is not limited thereto. Alternatively, other short-range wireless communication means, a wide-area communication network, and the like may be used as the communication means.

The analog electronic watch 2 is a watch including an analog display unit 26 (described later), and causes a user to recognize a display time as a time corresponding to a positional relation between a dial plate 26*a* and a second hand 26*b*, a minute hand 26*c*, an hour hand 26*d*, and a date plate 26*e* (hereinafter, also simply referred to as a "group of hands 26*b* to 26*e*") in the analog display unit 26. The analog electronic watch 2 includes an antenna 21, a watch-side communication unit 22, a watch-side controller 23, a watch-side power supply unit 24, a driving mechanism unit 25, the analog display unit 26, an operation unit 27, and a watch-side storage unit 28. In the analog electronic watch 2, an internal space part of an exterior case 29 forming the outermost part of the analog electronic watch 2 houses the antenna 21, the watch-side communication unit 22, the watch-side controller 23, the watch-side power supply unit 24, the driving mechanism unit 25, the analog display unit 26, and the watch-side storage unit 28. On the exterior case 29, a plurality of lugs 29*a* to 29*d* are formed to project outward from an annular part 29*e*. Two of the lugs 29*a* to 29*d* are formed to be separated from each other and project forward from a forward end part of the annular part 29*e*, and the other two thereof are formed to be separated from each other and project backward from a backward end part of the annular part 29*e*. In the analog electronic watch 2, one end of a belt is coupled to a part between a pair of lugs 29*a* and 29*b* on a forward side, and the other end of the belt is coupled to a part between a pair of lugs 29*c* and 29*d* on a backward side, so that the belt is annularly coupled to the exterior case 29. The analog electronic watch 2 according to the present embodiment is described as a wristwatch to be put on an arm of a user, but may be a desk clock or a wall clock.

The antenna 21 constitutes part of the watch-side communication unit, and receives radio waves of the Bluetooth (registered trademark) standard as one of short-range wireless communication standards. The antenna 21 is connected to the watch-side communication unit 22.

The watch-side communication unit 22 constitutes part of the watch-side communication unit, and can at least receive time information about a time from the outside and transmit watch identification information to the outside. The watch-side communication unit 22 includes a Bluetooth (registered trademark) module 22*a* and a conversion unit 22*b*. The Bluetooth (registered trademark) module 22*a* is a communication control module for performing Bluetooth (registered trademark) communication with the terminal equipment 3 on the outside through the antenna 21. The conversion unit 22*b* converts a serial signal into a parallel signal, or converts the parallel signal into the serial signal. Transmission information (transmission data) output from the watch-side controller 23 to be transmitted to the outside is subjected to signal processing such as serial/parallel conversion performed by the conversion unit 22*b*, and transmitted from the Bluetooth (registered trademark) module 22*a* to the terminal equipment 3 through the antenna 21. On the other hand, reception information (reception data) that is received by the Bluetooth (registered trademark) module 22*a* through the antenna 21 is subjected to signal processing such as serial/parallel conversion performed by the conversion unit 22*b*, and output to the watch-side controller 23.

The watch-side controller 23 controls various circuits, mechanisms, and the like included in the analog electronic watch 2, and controls at least rotation of the group of hands 26*b* to 26*e* rotated by the driving mechanism unit 25 based on the internal time of the watch. The watch-side controller 23 corrects display positions of the group of hands 26*b* to 26*e*, that is, corrects a display time based on display time information. The watch-side controller 23 also corrects the internal time of the watch based on reference time information received from the terminal equipment 3. The reference time information is time information corresponding to an internal time of a terminal (described later) of the terminal equipment 3. The watch-side controller 23 stores reference position information of the group of hands 26*b* to 26*e*, and updates the reference position information. The watch-side controller 23 includes a microcontroller 23*a*, a motor drive circuit 23*b*, a nonvolatile memory 23*c*, and a Real Time Clock (RTC) 23*d*.

The microcontroller 23*a* includes an arithmetic unit 23*e*, a random access memory (RAM) 23*f*, and a read only memory (ROM) 23*g*. The microcontroller 23*a* is constituted of one integrated circuit. The arithmetic unit 23*e* counts pulses included in a clock signal output from the RTC 23*d* using a counter (not illustrated). The arithmetic unit 23*e* performs various kinds of information processing in accordance with a program stored in the ROM 23*g*. The arithmetic unit 23*e* according to the present embodiment performs display time correction processing. The arithmetic unit 23*e* determines the internal time of the watch corresponding to the counted number of pulses. The RAM 23*f* functions as a work memory of the arithmetic unit 23*e*, and information as a processing target of the arithmetic unit 23*e* is written therein. The RAM 23*f* stores respective pieces of current display position information based on a control operation for the group of hands 26*b* to 26*e* for controlling rotation of the group of hands 26*b* to 26*e* with the driving mechanism unit 25 based on the internal time of the watch by the watch-side controller 23.

The motor drive circuit 23*b* outputs a drive signal for driving each of step motors 25*a* to 25*c* (described later) included in the driving mechanism unit 25 based on the internal time of the watch determined by the arithmetic unit 23*e*.

The nonvolatile memory 23*c* is a memory that holds information in a case in which electric power is not supplied to the watch-side controller 23 by the watch-side power supply unit 24, in a case of restarting the analog electronic watch 2, and the like. The nonvolatile memory 23*c* stores the reference position information of the group of hands 26*b* to 26*e*. The reference position information according to the present embodiment is information based on reference positions set in advance. As the reference positions, for example, the second hand 26*b*, the minute hand 26*c*, and the hour hand 26*d* are at positions indicating 12 o'clock on the dial plate 26*a*, and the date plate 26*e* is at a position at which "1" can be visually recognized through a date window 26*g* of the dial plate 26*a*. The reference position information is initial value information about the respective positions of the group of hands 26*b* to 26*e* at a reference time (first day 12:00:00 AM). The nonvolatile memory 23*c* is, for example, a flash memory and an EEPROM.

The RTC 23*d* outputs, to the microcontroller 23*a*, a clock signal used for timing within the analog electronic watch 2.

The watch-side power supply unit 24 is a power source of the analog electronic watch 2, and supplies electric power to each component in the analog electronic watch 2 such as the watch-side communication unit 22, the watch-side controller 23, and the driving mechanism unit 25. The watch-side power supply unit 24 includes a power generation circuit 24*a*, a battery 24*b*, and a power supply voltage detection circuit 24*c*.

The power generation circuit 24*a* includes a photovoltaic power generation element arranged below the dial plate 26*a* (described later) of the analog display unit 26. The power generation circuit 24*a* generates electric power using external light such as sunlight emitted to the dial plate 26*a*, and supplies the generated electric power to the battery 24*b*.

The battery 24*b* is a secondary cell that can be charged and discharged, for example, a lithium ion battery. The battery 24*b* is charged with electric power generated by the power generation circuit 24*a*, or discharges electric power to supply electric power to each component in the analog electronic watch 2 by a battery management circuit (not illustrated) that manages charge and discharge.

The power supply voltage detection circuit 24*c* is a circuit for measuring voltage of the battery 24*b*. A signal indicating the measured voltage is output to the microcontroller 23*a*.

The driving mechanism unit 25 includes a plurality of step motors 25*a*, 25*b*, and 25*c* that are driven to rotate (for example, by 180 degrees for each control pulse) in accordance with the drive signal output from the motor drive circuit 23*b*, and a wheelwork (not illustrated). When the wheelwork transmits rotational force of each of the step motors 25*a* to 25*c*, the driving mechanism unit 25 rotates the group of hands 26*b* to 26*e* by a rotation amount per once set in advance. According to the present embodiment, the second hand 26*b* is rotated by the step motor 25*a*, the minute hand 26*c* and the hour hand 26*d* are rotated by the step motor 25*b*, and the date plate 26*e* is rotated by the step motor 25*c*. The minute hand 26*c* and the hour hand 26*d* rotate in a linked manner. The hour hand 26*d* rotates at a ratio of 1/12 with respect to rotational speed of the minute hand 26*c* in a linked manner. The step motors 25*a* to 25*c* rotate the second hand 26*b* by a rotation amount of once per minute, rotates the minute hand 26*c* by a rotation amount of once per hour, and rotates the date plate 26*e* by a rotation amount of once per month.

The analog display unit 26 is disposed at a position that can be visually recognized from the outside in the analog electronic watch 2. As illustrated in FIGS. 1 and 2, the analog display unit 26 is disposed on a downward side with respect to a transmissive wind shield WS in a housing space part of the exterior case 29, and includes the dial plate 26*a*, the second hand 26*b*, the minute hand 26*c*, the hour hand 26*d*, and the date plate 26*e*. The dial plate 26*a* is formed in a disk shape, and transmits external light. On the dial plate 26*a*, indexes 26*f* and the date window 26*g* are formed. The indexes 26*f* cause the user to recognize a current time using a relative position among the second hand 26*b*, the minute hand 26*c*, and the hour hand 26*d* (hereinafter, also simply referred to as "three hands 26*b* to 26*d*". The indexes 26*f* are formed at regular intervals in a circumferential direction with respect to the dial plate 26*a*. Some of the indexes 26*f* according to the present embodiment are formed at regular intervals of 6 degrees, and some of the indexes 26*f* are formed at regular intervals of 30 degrees. The date window 26*g* is formed at a position opposed to the date plate 26*e* in a vertical direction with respect to the dial plate 26*a*, and passes through the dial plate 26*a* vertically. The date window 26*g* according to the present embodiment has a rectangular shape, and is formed at a position of "3 o'clock" on the dial plate 26*a*. The second hand 26*b*, the minute hand 26*c*, and the hour hand 26*d* are supported by a frame (not illustrated) in a rotatable manner, and coaxially rotate on an upper side of the dial plate 26*a*, for example, at a center part of the dial plate 26*a*. The second hand 26*b*, the minute hand 26*c*, and the hour hand 26*d* point positions with respect to the indexes 26*f* on the dial plate 26*a* to indicate a second, a minute, and an hour of the display time. The date plate 26*e* is supported by a frame (not illustrated) in a rotatable manner, and rotates on a lower side of the dial plate 26*a*. The date plate 26*e* can be exposed to the upper side of the dial plate 26*a* through the date window 26*g*, and indicates "date" of the time through the date window 26*g*. The date plate 26*e* is formed by arranging identification patterns for identifying the date, that is, numerals of 1 to 31 according to the present embodiment, in a circumferential direction at regular intervals. The second hand 26*b* indicates "second" of the current time, the minute hand 26*c* indicates "minute" of the current time, and the hour hand 26*d* indicates "hour" of the current time. The three hands 26*b* to 26*d* according to the present embodiment are formed in descending order of the lengths of the hour hand 26*d*, the minute hand 26*c*, and the second hand 26*b* from the center of the dial plate 26*a* in a radial direction of rotation.

The operation unit 27 is, for example, a crown and an operation button. When the user operates the operation unit 27, operation content corresponding to an input operation is output to the watch-side controller 23. The watch-side controller 23 performs various kinds of processing in accordance with the operation content. Assuming that the position of "12 o'clock" of the analog electronic watch 2 is at 0 degrees with respect to the exterior case 29, the operation unit 27 according to the present embodiment is disposed at a position of "3 o'clock", that is, a position at 90 degrees.

The watch-side storage unit 28 stores watch identification information. The watch identification information is information about a type, a color, a manufacture year, and the like of the analog electronic watch 2, that is, information such as what is called a serial number and a production number. The watch-side storage unit 28 stores a passkey for pairing (described later), and alarm information in a case in which the analog electronic watch 2 has an alarm function. The watch-side storage unit 28 is, for example, a flash memory or an EEPROM.

The terminal equipment 3 is independent of the analog electronic watch 2. In the terminal equipment 3, a display time correction application (hereinafter, also simply referred to as an "application") corresponding to a display time correction function of the analog electronic watch system 1 is stored in a terminal-side storage unit 37 (described later) of the terminal equipment 3 at an initial stage (at the time of factory shipment), or stored in the terminal-side storage unit 37 by being downloaded from an external server 200 through an internet network 100 or being read from a connected recording medium. The terminal equipment 3 according to the present embodiment is a portable terminal such as a smartphone and a tablet having a function as the analog electronic watch system 1 as part of functions and having other functions, for example, a telephone function, an internet connecting function, and the like. However, the terminal equipment 3 is not limited thereto, and may be a personal computer such as a notebook computer. As illustrated in FIGS. 1 and 3, the terminal equipment 3 includes an imaging unit 31, a touch panel unit 32, an antenna 33, a terminal-side communication unit 34, a terminal-side controller 35, a terminal-side power supply unit 36, a terminal-side storage unit 37, a built-in clock unit 38, and a voice input/output unit 39. For example, a vibration generation unit may be added to the terminal equipment 3 in accordance with a required function.

The imaging unit 31 images the dial plate 26*a* of the analog electronic watch 2, and generates an image P of the hands and the dial plate including the group of hands 26*b* to 26*e* and the dial plate 26*a* as illustrated in FIG. 4. The imaging unit 31 is disposed on a back surface of the terminal equipment 3 (the surface opposite to a surface on which a display surface 32*a* (described later) of the touch panel unit 32 is disposed), and includes an imaging sensor 31*a* such as a CCD image sensor and a CMOS image sensor in which imaging elements to be driven by electric power from the terminal-side power supply unit 36 are arranged in a plane shape. The imaging sensor 31*a* generates the image P of the hands and the dial plate based on an output value corresponding to incident light at each time of exposure, and outputs the image P to the terminal-side controller 35 as an image signal. The imaging unit 31 controls driving of each imaging element based on imaging conditions for the imaging sensor 31*a*, that is, exposure timing, exposure time, white balance, and the like. The image P of the hands and the dial plate includes an image corresponding to the dial plate 26*a*, an image corresponding to the second hand 26*b*, an image corresponding to the minute hand 26*c*, an image corresponding to the hour hand 26*d*, an image of the date plate 26*e* corresponding to a portion exposed from the date window 26*g*, an image corresponding to the indexes 26*f*, and an image corresponding to the exterior case 29.

The touch panel unit 32 is a display that functions as a display unit and an input unit. The touch panel unit 32 includes the display surface 32*a* as a function of the display unit, and displays the image P of the hands and the dial plate taken by the imaging unit 31 on the display surface 32*a*. The touch panel unit 32 is a display disposed on a surface of the terminal equipment 3 such as a liquid crystal display and an organic EL display driven by electric power from the terminal-side power supply unit 36. The touch panel unit 32 displays the image P of the hands and the dial plate that is an image taken by the imaging unit 31 based on an image data signal output from the terminal-side controller 35. When the user presses an optional position of the touch panel unit 32 as the function of the input unit, an operation input signal corresponding to an operation input position is output to the terminal-side controller 35.

The antenna 33 constitutes part of the terminal-side communication unit, and receives at least radio waves of the Bluetooth (registered trademark) standard. The antenna 33 is connected to the terminal-side communication unit 34.

The terminal-side communication unit 34 constitutes part of the terminal-side communication unit, and can at least transmit time information about a time to the outside and receive the watch identification information from the outside. The terminal-side communication unit 34 according to the present embodiment receives the watch identification information from the analog electronic watch 2 and hand identification information from the external server 200, and transmits current display time information to the analog electronic watch 2. Similarly to the watch-side communication unit 22, the terminal-side communication unit 34 includes a conversion unit and a Bluetooth (registered trademark) module (not illustrated) for at least performing Bluetooth (registered trademark) communication with the analog electronic watch 2 on the outside through the antenna 33. Transmission information (transmission data) output from the terminal-side controller 35, for example, time information, is subjected to signal processing performed by the conversion unit of the terminal-side communication unit 34, and transmitted from the Bluetooth (registered trademark) module to the analog electronic watch 2 through the antenna 33. On the other hand, reception information (reception data) that is received by the Bluetooth (registered trademark) module of the terminal-side communication unit 34 through the antenna 33, for example, the time information, is subjected to signal processing performed by the conversion unit, and output to the terminal-side controller 35. The terminal-side communication unit 34 can transmit and receive information to/from the internet network 100 including base stations installed in various places through wireless communication. That is, the terminal-side communication unit 34 can transmit and receive information to/from the external server 200 through the internet network 100. The external server 200 stores the watch identification information and the hand identification information (described later) in an associated state.

The terminal-side controller 35 controls an appliance constituting the terminal equipment 3 including the imaging unit 31. By executing the application, the terminal-side controller 35 stops rotation of the group of hands 26*b* to 26*e* of the analog electronic watch 2, and achieves imaging of the analog display unit 26 in a rotation stopped state of the analog electronic watch 2. The terminal-side controller 35 also acquires the hand identification information to be stored in the terminal-side storage unit 37. At the time when communication with the analog electronic watch 2 is established, the terminal-side controller 35 according to the present embodiment acquires the hand identification information from the external server 200 on the outside through the internet network 100. The terminal-side controller 35 performs image processing on the image P of the hands and the dial plate generated by the imaging unit 31, and detects current display positions of the group of hands 26*b* to 26*e* based on the hand identification information. The terminal-side controller 35 outputs the current display time information to the analog electronic watch 2 based on the detected current display positions. A hardware configuration of the terminal-side controller 35 is the same as a hardware configuration of a controller of well-known terminal equipment, and includes an arithmetic unit, a RAM, and a ROM (not illustrated), for example.

The terminal-side power supply unit 36 is a power source of the terminal equipment 3, and supplies electric power to the respective components within the terminal equipment 3 such as the imaging unit 31, the touch panel unit 32, the terminal-side communication unit 34, the terminal-side controller 35, the terminal-side storage unit 37, the built-in clock unit 38, and the voice input/output unit 39. The terminal-side power supply unit 36 includes at least a battery that can be charged and discharged.

The terminal-side storage unit 37 stores various programs including a program corresponding to a display time correction application executed by the terminal-side controller 35, initial setting information, and the like. The terminal-side storage unit 37 stores the hand identification information. The hand identification information is information including at least hand shape information about a shape of the hand of the analog electronic watch 2. The hand identification information according to the present embodiment is color information and shape information of the dial plate 26*a*, the second hand 26*b*, the minute hand 26*c*, the hour hand 26*d*, and the exterior case 29 of the analog electronic watch 2. The terminal-side storage unit 37 is, for example, a flash memory or an EEPROM.

The built-in clock unit 38 is a counter that times an internal time of the terminal to be held therein. In the terminal equipment 3, the internal time of the terminal is read out by the terminal-side controller 35, and displayed on the display surface 32*a* of the touch panel unit 32. In the terminal equipment 3, the terminal-side controller 35 compares the internal time of the terminal with a setting time to perform various operations. At the time when communication between the terminal equipment 3 and the base station is performed by the terminal-side communication unit 34, the internal time of the terminal is updated by the terminal-side controller 35 as needed based on base station-side time information acquired from the base station.

The voice input/output unit 39 transmits information mainly between the user and the terminal equipment 3 with voice. The voice input/output unit 39 includes a microphone 39*a* and a speaker 39*b*. The microphone 39*a* is mainly used for inputting voice of the user, and converts sound waves into a voice signal to be output to the terminal-side controller 35 and the like. The speaker 39*b* is mainly used for outputting voice to the user, and converts the voice signal output from the terminal-side controller 35 and the like into sound waves to be output to the outside of the terminal equipment 3.

Figure 5:
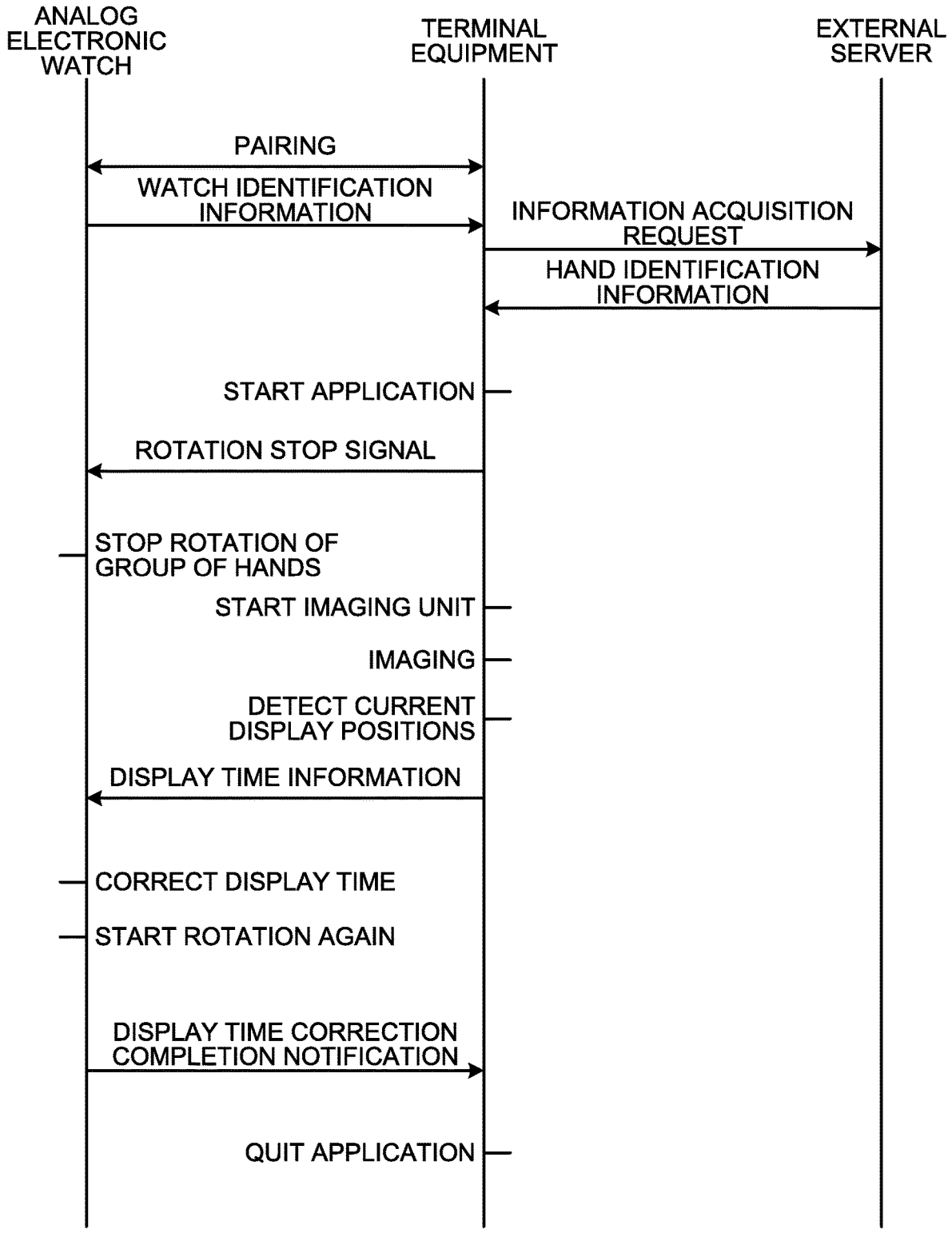
FIG. 5 is a sequence diagram of the analog electronic watch system according to the embodiment.
Figure 6:
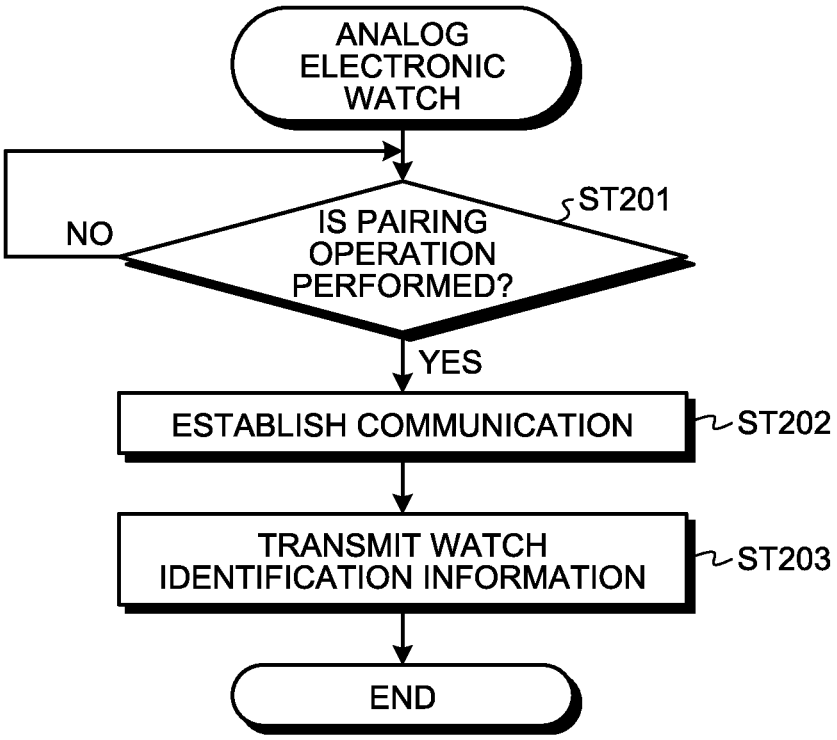
FIG. 6 is a flowchart of communication establishment processing performed by the analog electronic watch.
Figure 7:
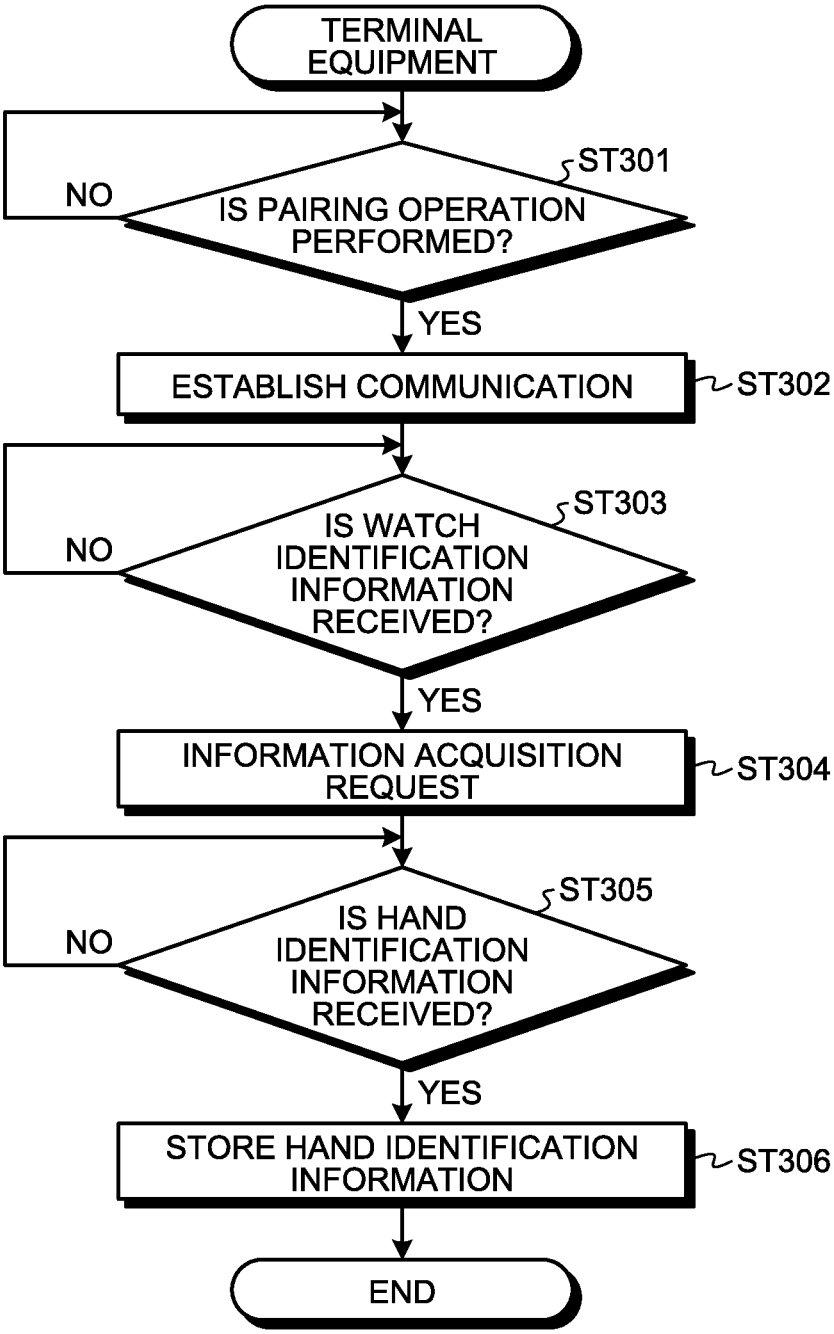
FIG. 7 is a flowchart of communication establishment processing performed by the terminal equipment.
Figure 8:
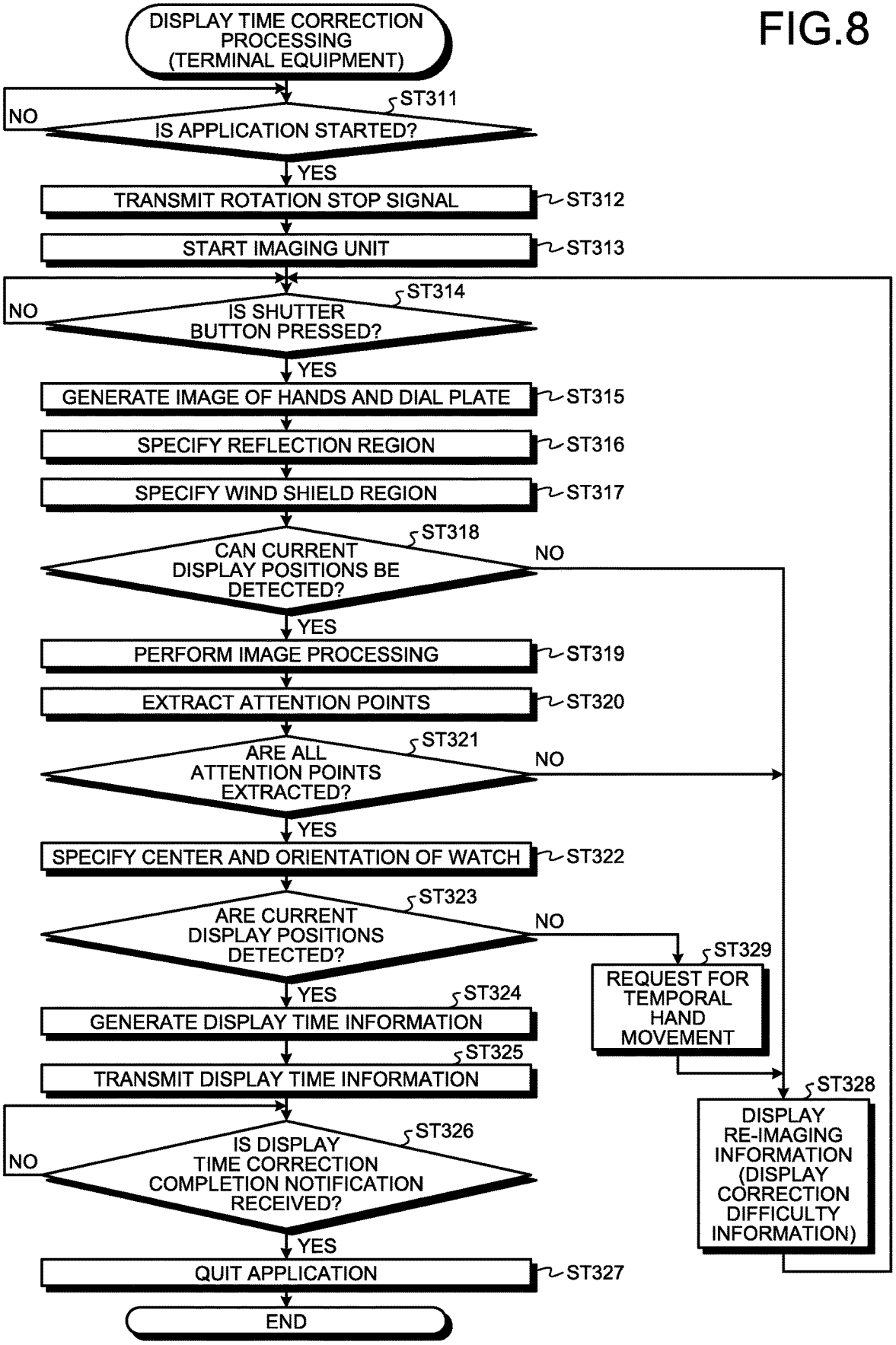
FIG. 8 is a flowchart of display time correction processing performed by terminal equipment according to a first embodiment.
Figure 9:
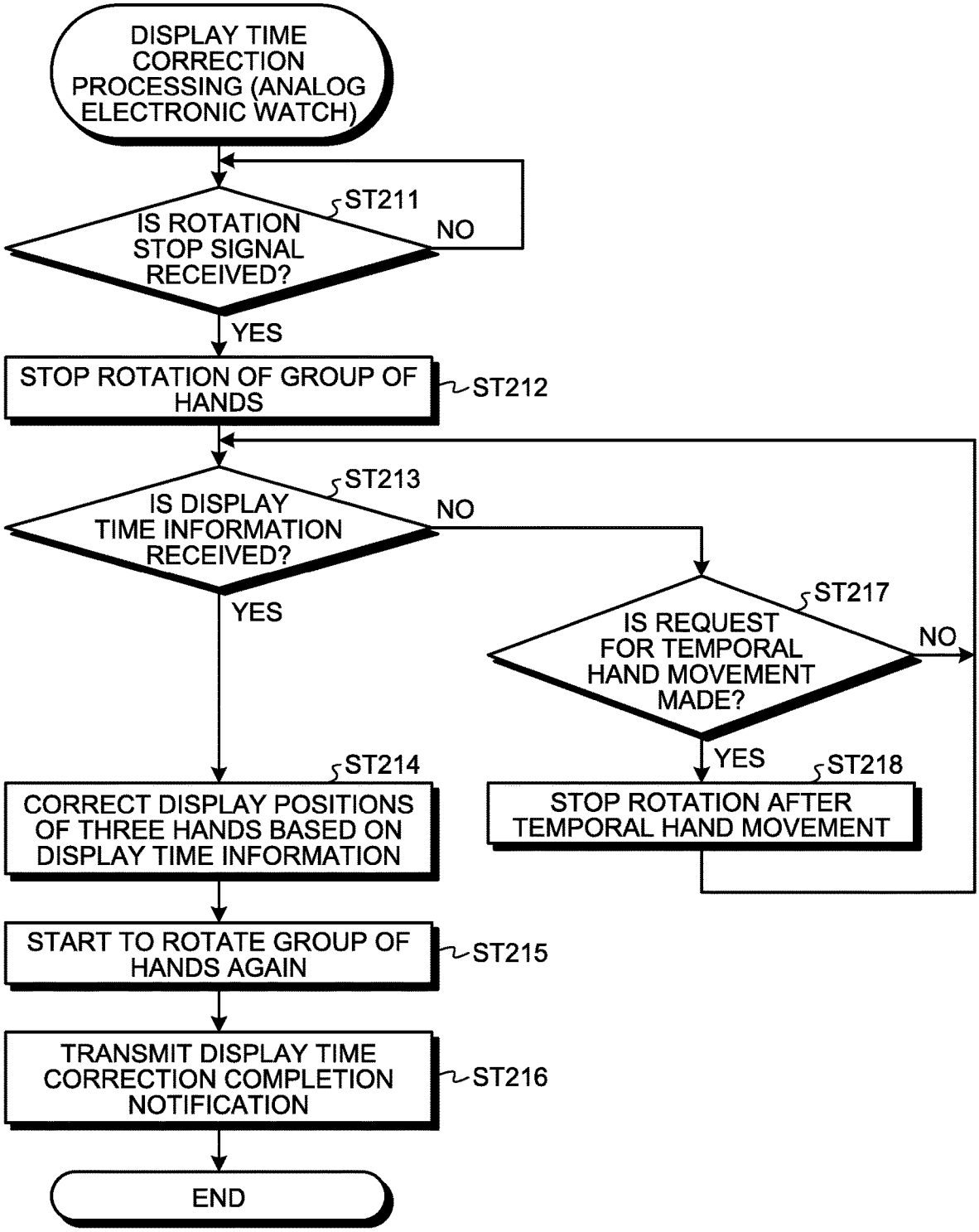
FIG. 9 is a flowchart of display time correction processing performed by the analog electronic watch.
Figure 10:
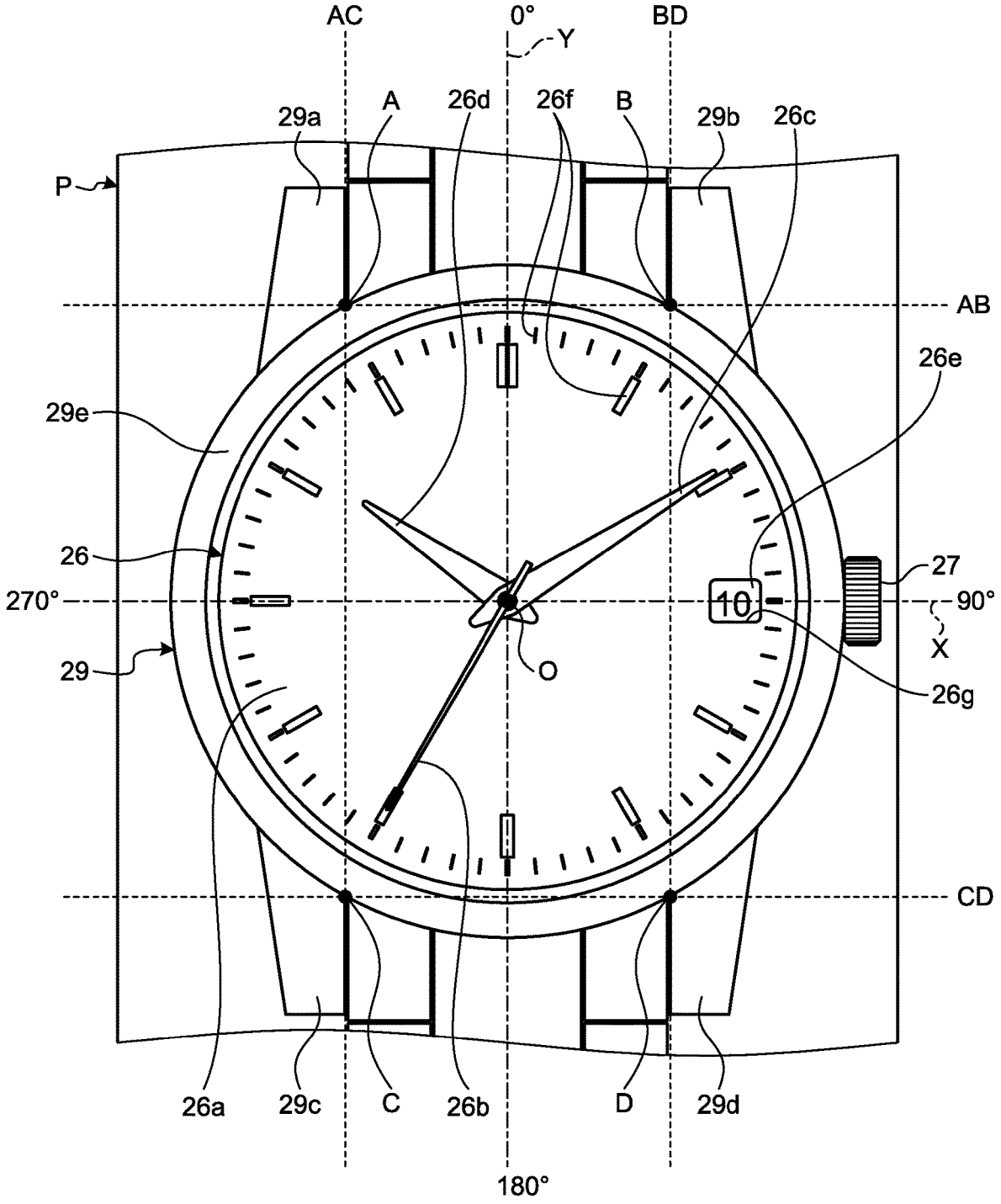
FIG. 10 is an explanatory diagram of processing of specifying a center and orientation of the watch.
Figure 11:
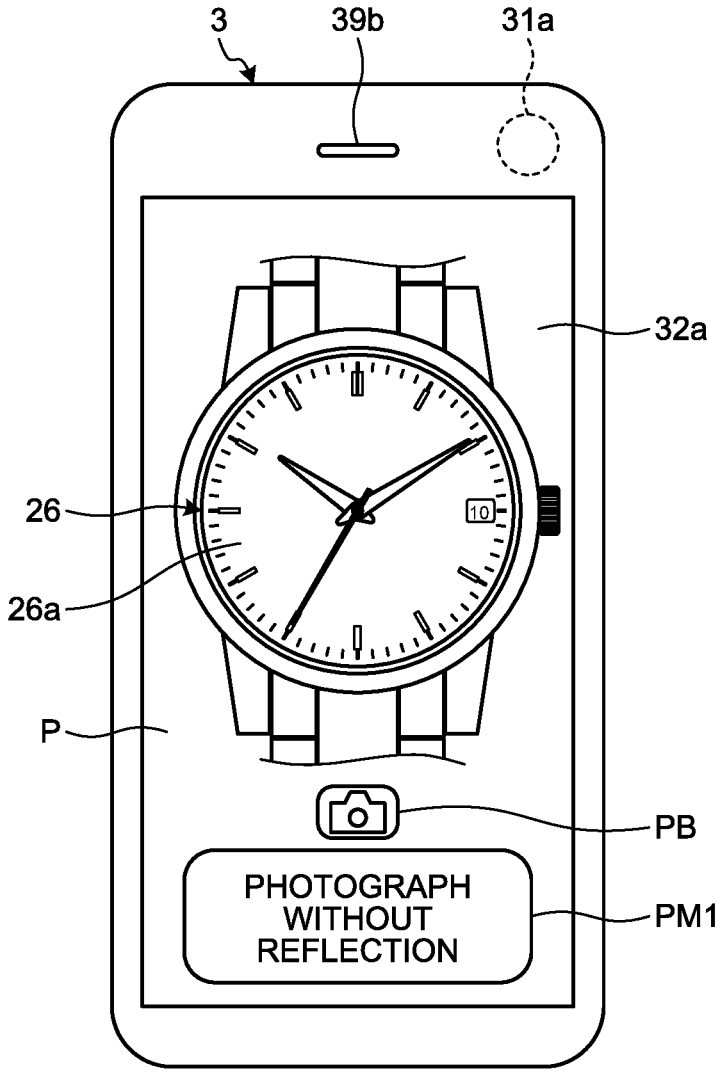
FIG. 11 is a diagram illustrating an example of a correction difficulty information display image on a display surface of the terminal equipment according to the present embodiment.

Subsequently, the following describes display time correction performed by the analog electronic watch system 1 according to the first embodiment. First, the following describes communication establishment processing between the analog electronic watch 2 and the terminal equipment 3. FIG. 5 is a sequence diagram of the analog electronic watch system according to the embodiment. FIG. 6 is a flowchart of communication establishment processing performed by the analog electronic watch. FIG. 7 is a flowchart of communication establishment processing performed by the terminal equipment. FIG. 8 is a flowchart of display time correction processing performed by the terminal equipment according to the first embodiment. FIG. 9 is a flowchart of display time correction processing performed by the analog electronic watch. FIG. 10 is an explanatory diagram of processing of specifying a center and orientation of the watch. FIG. 11 is a diagram illustrating an example of a correction difficulty information display image on the display surface of the terminal equipment according to the present embodiment. FIG. 5 is a sequence diagram illustrating processes performed by the analog electronic watch 2, the terminal equipment 3, and the external server 200 in order.

First, as illustrated in FIG. 5, the user performs pairing. In this case, the user performs a pairing operation on the analog electronic watch 2 and the terminal equipment 3. For example, the user performs the pairing operation on the analog electronic watch 2 by operating the operation unit 27 of the analog electronic watch 2. The user operates the touch panel unit 32 of the terminal equipment 3 to display a setting screen for pairing on the display surface 32*a*, and presses an icon of a button for executing pairing. The analog electronic watch 2 performs the pairing operation using the operation unit 27, but the embodiment is not limited thereto. The analog electronic watch 2 may perform the pairing operation using an operation unit different from the operation unit 27 such as a switch. The following describes the sequence illustrated in FIG. 5 in order with reference to FIG. 6 and the following drawings.

Next, as illustrated in FIG. 6, the watch-side controller 23 of the analog electronic watch 2 determines whether the pairing operation is performed (Step ST201).

Next, if it is determined that the pairing operation is performed (Yes at Step ST201), the watch-side controller 23 establishes communication with the terminal equipment 3 (Step ST202). When the pairing operation is performed by the user, the watch-side controller 23 transmits a signal for establishing communication to the terminal equipment 3 by the watch-side communication unit 22, and the watch-side communication unit 22 receives the signal for establishing communication including a passkey from the terminal equipment 3. If the passkey included in the signal for establishing communication from the terminal equipment 3 is matched with a passkey stored in the watch-side controller 23, a communication establishment completion signal is transmitted to the terminal equipment 3 by the watch-side communication unit 22, and communication with the terminal equipment 3 is established. If it is determined that the pairing operation is not performed (No at Step ST201), the watch-side controller 23 repeatedly performs Step ST201 until the pairing operation is performed.

Next, the watch-side controller 23 transmits the watch identification information (Step ST203). When communication with the terminal equipment 3 is established, the watch-side controller 23 transmits, to the terminal equipment 3, the watch identification information stored in the watch-side storage unit 28 by the watch-side communication unit 22.

On the other hand, as illustrated in FIG. 7, the terminal-side controller 35 of the terminal equipment 3 determines whether the pairing operation is performed (Step ST301).

Next, if it is determined that the pairing operation is performed (Yes at Step ST301), the terminal-side controller 35 establishes communication with the analog electronic watch 2 (Step ST302). When the user performs the pairing operation, the terminal-side controller 35 receives the signal for establishing communication from the analog electronic watch 2, transmits the signal for establishing communication including the passkey to the analog electronic watch 2 by the terminal-side communication unit 34, and receives the communication establishment completion signal from the analog electronic watch 2 to establish communication with the analog electronic watch 2. If it is determined that the pairing operation is not performed (No at Step ST301), the terminal-side controller 35 repeatedly performs Step ST301 until the pairing operation is performed.

Next, the terminal-side controller 35 determines whether the watch identification information is received (Step ST303).

Next, if it is determined that the watch identification information is received (Yes at Step ST303), the terminal-side controller 35 makes an information acquisition request (Step ST304). To acquire the hand identification information from the external server 200, the terminal-side controller 35 requests the hand identification information from the external server 200 through the internet network 100 by the terminal-side communication unit 34. The external server 200 stores a plurality of pieces of hand identification information associated with the watch identification information. The respective pieces of hand identification information correspond to a type, a color, a manufacture year, and the like of the analog electronic watch 2. If it is determined that the watch identification information is not received (No at Step ST303), the terminal-side controller 35 repeatedly performs Step ST303 until the watch identification information is received.

Next, the terminal-side controller 35 determines whether the hand identification information is received (Step ST305). In this case, the terminal-side controller 35 determines whether the terminal-side communication unit 34 receives, from the external server 200, the hand identification information corresponding to the watch identification information of the analog electronic watch 2 with which communication is established, as a result of making the information acquisition request to the external server 200.

Next, if it is determined that the hand identification information is received (Yes at Step ST305), the terminal-side controller 35 stores the hand identification information (Step ST306). When the terminal-side communication unit 34 receives the hand identification information, the terminal-side controller 35 stores the hand identification information in the terminal-side storage unit 37. Due to this, the terminal equipment 3 acquires the hand identification information based on the watch identification information. If it is determined that the hand identification information is not received (No at Step ST305), the terminal-side controller 35 repeatedly performs Step ST305 until the hand identification information is received.

As described above, the analog electronic watch system 1 according to the present embodiment acquires the hand identification information corresponding to the watch identification information of the analog electronic watch 2 from the outside of the terminal equipment 3 through the terminal-side communication unit 34. The terminal equipment 3 can correct the display position of any analog electronic watch 2 that can establish communication with the terminal equipment 3, so that, in a case of storing the hand identification information in the terminal-side storage unit 37 in advance, the terminal-side storage unit 37 may store the hand identification information corresponding to all analog electronic watches 2 the display position of which can be corrected. However, in this case, a large storage capacity is required for the terminal-side storage unit 37. On the other hand, in the terminal equipment 3 according to the present embodiment, the hand identification information of the analog electronic watch 2 the display position of which is corrected by the terminal equipment 3 is not required to be stored in the terminal-side storage unit 37 in advance, so that the storage capacity of the terminal-side storage unit 37 for storing the hand identification information can be reduced.

Next, the following describes display time correction processing after the communication between the analog electronic watch 2 and the terminal equipment 3 is established. First, the user starts a display time correction application by the terminal equipment 3. To start the application, for example, the user presses an icon of a start button corresponding to the application displayed on the display surface 32*a* (performs an operation input to an icon display position of the start button on the display surface 32*a*).

Next, as illustrated in FIG. 8, the terminal-side controller 35 of the terminal equipment 3 determines whether the application is started (Step ST311).

Next, if it is determined that the application is started (Yes at Step ST311), the terminal-side controller 35 transmits a rotation stop signal to the analog electronic watch 2 (Step ST312). At this point, the group of hands 26*b* to 26*e* of the analog electronic watch 2 are in a rotation state, so that the terminal-side controller 35 outputs the rotation stop signal for stopping rotation of the group of hands 26*b* to 26*e* to the watch-side controller 23 through the terminal-side communication unit 34 and the watch-side communication unit 22 so that the imaging unit 31 can perform imaging in a state in which the group of hands 26*b* to 26*e* are stopped. If it is determined that the application is not started (No at Step ST311), the terminal-side controller 35 repeatedly performs Step ST311 until the application is started.

Next, as illustrated in FIG. 9, the watch-side controller 23 of the analog electronic watch 2 determines whether the rotation stop signal is received (Step ST211).

Next, if it is determined that the rotation stop signal is received (Yes at Step ST211), the watch-side controller 23 stops rotation of the group of hands 26*b* to 26*e* (Step ST212).

In this case, the watch-side controller 23 causes the motor drive circuit 23*b* to stop outputting the drive signal to the driving mechanism unit 25. Due to this, in the analog electronic watch 2, the group of hands 26*b* to 26*e* are stopped at the current display positions. The watch-side controller 23 prohibits the counter from counting, and stops updating the internal time of the watch, that is, stops timing the internal time of the watch. If it is determined that the rotation stop signal is not received (No at Step ST211), the watch-side controller 23 repeatedly performs Step ST211 until the rotation stop signal is received.

Next, the terminal-side controller 35 starts the imaging unit 31 (Step ST313). The terminal-side controller 35 starts the imaging unit 31 to image the analog display unit 26 in which the group of hands 26*b* to 26*e* are in a rotation stopped state. When the imaging unit 31 is started, the terminal-side controller 35 causes the display surface 32*a* to display an image based on an image signal that is output from the imaging unit 31 in real time. That is, by visually recognizing the display surface 32*a*, the user can check a subject to be imaged by the imaging unit 31, that is, the analog electronic watch 2. As illustrated in FIG. 1, the terminal-side controller 35 displays a shutter button, as an icon PB, for instructing the imaging unit 31 to perform imaging on the display surface 32*a*. The terminal-side controller 35 may cause the display surface 32*a* to display a caution to the user to perform imaging after the rotation of the analog electronic watch 2 is stopped.

Next, the terminal-side controller 35 determines whether the shutter button is pressed (Step ST314).

Next, if it is determined that the shutter button is pressed (Yes at Step ST314), the terminal-side controller 35 generates the image P of the hands and the dial plate (Step ST315). When the user presses the icon PB, the terminal-side controller 35 outputs, to the imaging unit 31, an imaging instruction signal for instructing the imaging unit 31 to perform imaging, and the imaging unit 31 performs imaging to generate the image P of the hands and the dial plate. If it is determined that the shutter button is not pressed (No at Step ST314), the terminal-side controller 35 repeatedly performs Step ST314 until the shutter button is pressed.

Next, the terminal-side controller 35 specifies a reflection region (Step ST316). In this case, the terminal-side controller 35 specifies the reflection region, that is, a region of the generated image P of the hands and the dial plate corresponding to the analog display unit 26 that may be incapable of being recognized due to reflection of disturbance light from the wind shield WS. Based on information about luminance of each pixel of the image P of the hands and the dial plate, for example, an RGB value, the terminal-side controller 35 according to the present embodiment extracts pixels having the RGB value equal to or larger than a predetermined value to specify the reflection region. The predetermined value is set based on the color information of the second hand 26*b*, the minute hand 26*c*, the hour hand 26*d*, and the exterior case 29 of the analog electronic watch 2 included in the hand identification information. For example, in specifying a reflection region on the image P of the hands and the dial plate, the dial plate 26*a* painted in white makes it difficult to determine whether a region to be specified is reflection of disturbance light from the wind shield WS or is the dial plate 26*a* itself. By setting the predetermined value based on the color information of the analog electronic watch 2 included in the hand identification information, it is possible to determine whether the region is reflection of disturbance light from the wind shield WS or is a region corresponding to the analog electronic watch 2 with high accuracy. Due to this, the reflection region can be accurately specified, so that it is possible to improve detection accuracy for the current display positions of the three hands 26*b* to 26*d* on the image P of the hands and the dial plate.

Next, the terminal-side controller 35 specifies a wind shield region (Step ST317). In this case, the terminal-side controller 35 specifies a region corresponding to the wind shield WS positioned on an upward side of the analog display unit 26 on the image P of the hands and the dial plate. The terminal-side controller 35 according to the present embodiment specifies the region corresponding to the wind shield WS based on the hand identification information. Specifically, the terminal-side controller 35 specifies, as the region corresponding to the wind shield WS, a region corresponding to a circle having a diameter corresponding to an outer diameter of the wind shield WS as a concentric circle of the largest circle of the exterior case 29, based on the shape information of the exterior case 29 included in the hand identification information. The terminal-side controller 35 may extract circular shapes from the image P of the hands and the dial plate to specify, as the region corresponding to the wind shield WS, a region corresponding to the smallest circle as a concentric circle of the largest circle among the extracted circular shapes.

Next, the terminal-side controller 35 determines whether the current display positions can be detected based on the image P of the hands and the dial plate (Step ST318). In this case, the terminal-side controller 35 determines whether the current display positions can be detected based on the reflection region. Specifically, the terminal-side controller 35 determines whether the current display positions can be detected based on a ratio of the reflection region to the region corresponding to the wind shield WS in the image P of the hands and the dial plate, that is, an area of the reflection region with respect to the analog electronic watch 2, that is, the wind shield WS in the present embodiment. For example, assuming that the region corresponding to the wind shield WS is 100%, the terminal-side controller 35 determines whether the ratio of the reflection region to the region corresponding to the wind shield WS is equal to or smaller than 10%.

Next, if it is determined that the current display positions can be detected based on the image P of the hands and the dial plate (Yes at Step ST318), the terminal-side controller 35 performs image processing on the image P of the hands and the dial plate (Step ST319). In this case, the terminal-side controller 35 performs image processing on the image P of the hands and the dial plate to enable the current display positions to be easily detected based on the hand identification information. The terminal-side controller 35 according to the present embodiment performs edge detection processing on the image P of the hands and the dial plate based on luminance, a color temperature, and the like to binarize the image P of the hands and the dial plate. The terminal-side controller 35 then performs black/white inversion processing on the binarized image P of the hands and the dial plate. The terminal-side controller 35 does not necessarily perform the black/white inversion processing on the binarized image P of the hands and the dial plate.

Next, the terminal-side controller 35 extracts an attention point based on the image P of the hands and the dial plate (Step ST320). In this case, the terminal-side controller 35 extracts a plurality of attention points to specify the center and orientation of the watch from the image P of the hands and the dial plate on which image processing is performed. Specifically, as illustrated in FIG. 10, the terminal-side controller 35 extracts four attention points A to D separated from each other on the exterior case 29 in the image P of the hands and the dial plate. On the exterior case 29, a belt-side end part of a coupling part between the annular part 29*e* and the lug 29*a* is assumed to be the attention point A, a belt-side end part of a coupling part between the annular part 29*e* and the lug 29*b* is assumed to be the attention point B, a belt-side end part of a coupling part between the annular part 29*e* and the lug 29*c* is assumed to be the attention point C, and a belt-side end part of a coupling part between the annular part 29*e* and the lug 29*d* is assumed to be the attention point D.

Next, as illustrated in FIG. 8, the terminal-side controller 35 determines whether all of the attention points A to D are extracted (Step ST321). In this case, the terminal-side controller 35 determines whether all of the attention points A to D are extracted from the image P of the hands and the dial plate on which image processing is performed.

Next, if it is determined that all of the attention points A to D are extracted (Yes at Step ST321), the terminal-side controller 35 specifies the center and orientation of the watch (Step ST322). In this case, the terminal-side controller 35 specifies a center O of the watch and orientation of the watch for the analog electronic watch 2 based on the extracted attention points A to D. The center O of the watch according to the present embodiment is a rotation center of the group of hands 26*b* to 26*e*, and is a center of the exterior case 29. The orientation of the watch according to the present embodiment is at a position of "12 o'clock" of the analog electronic watch 2, that is, a position at 0 degrees. Specifically, as illustrated in FIG. 10, the terminal-side controller 35 generates a straight line AB passing through the attention point A and the attention point B, a straight line CD passing through the attention point C and the attention point D, a straight line AC passing through the attention point A and the attention point C, and a straight line BD passing through the attention point B and the attention point D. Next, the terminal-side controller 35 assumes, based on the straight line AB and the straight line CD, a straight line that is positioned at the center between the straight line AB and the straight line CD and is parallel with the straight line AB and the straight line CD to be a straight line X, and assumes, based on the straight line AC and the straight line BD, a straight line that is positioned at the center between the straight line AC and the straight line BD and is parallel with the straight line AC and the straight line BD to be a straight line Y. The terminal-side controller 35 specifies a point at which the straight line X intersects with the straight line Y as the center O of the watch. The terminal-side controller 35 specifies, as the position at 0 degrees, a line obtained by rotating a line passing through the center O of the watch and the center of the crown as the operation unit 27 in the Y-direction along a straight line by 90 degrees counterclockwise about the center O of the watch as a rotation center, that is, an extending direction from the center O of the watch.

Next, the terminal-side controller 35 determines whether the current display positions are detected (Step ST323). In this case, the terminal-side controller 35 detects the second hand 26*b*, the minute hand 26*c*, and the hour hand 26*d* based on the hand identification information, and detects the current display positions with respect to the dial plate 26*a*. The terminal-side controller 35 according to the present embodiment extracts a region corresponding to the second hand 26*b*, a region corresponding to the minute hand 26*c*, and a region corresponding to the hour hand 26*d* from the image P of the hands and the dial plate through pattern matching processing based on the shapes of the second hand 26*b*, the minute hand 26*c*, and the hour hand 26*d* as the hand identification information and the image P of the hands and the dial plate on which image processing is performed. Next, the terminal-side controller 35 calculates rotation angles of the three hands 26*b* to 26*d* with respect to the position at 0 degrees based on the extracted regions corresponding to the three hands 26*b* to 26*d*, the center O of the watch, and the orientation of the watch. Due to this, the terminal-side controller 35 detects the current display positions of the three hands 26*b* to 26*d*.

Next, if it is determined that the current display positions are detected (Yes at Step ST323), the terminal-side controller 35 generates display time information (Step ST324). In this case, the terminal-side controller 35 specifies "second", "minute", and "hour" of the display time based on the detected rotation angles of the three hands 26*b* to 26*d*.

Next, the terminal-side controller 35 transmits the display time information to the analog electronic watch 2 (Step ST325). At this point, the group of hands 26*b* to 26*e* of the analog electronic watch 2 are in a rotation stopped state, so that the terminal-side controller 35 outputs the current display positions of the three hands 26*b* to 26*d* to the watch-side controller 23 through the terminal-side communication unit 34 and the watch-side communication unit 22 so that the group of hands 26*b* to 26*e* can be rotated by the driving mechanism unit 25 in a state in which timing of the internal time of the watch is stopped. The terminal-side controller 35 according to the present embodiment outputs reference time information to the watch-side controller 23 together with the display time information.

Next, as illustrated in FIG. 9, the watch-side controller 23 determines whether the display time information is received (Step ST213).

Next, if it is determined that the display time information is received (Yes at Step ST213), the watch-side controller 23 corrects the display positions of the three hands 26*b* to 26*d* based on the display time information (Step ST214). In this case, the watch-side controller 23 compares the display time information with the internal time of the watch, and the motor drive circuit 23*b* outputs a drive signal to the respective step motors 25*a* and 25*b* of the driving mechanism unit 25 so that the display time is matched with the internal time of the watch based on a difference in each of a second, a minute, and an hour to rotate the three hands 26*b* to 26*d* based on the display time information. The watch-side controller 23 according to the present embodiment compares the internal time of the watch with the display time corresponding to the display time information and the reference time corresponding to the reference time information, and the motor drive circuit 23*b* outputs the drive signal to the respective step motors 25*a* and 25*b* of the driving mechanism unit 25 based on a difference in each of a second, a minute, and an hour. That is, in the watch-side controller 23, the motor drive circuit 23*b* outputs the drive signal to the respective step motors 25*a* and 25*b* of the driving mechanism unit 25 so that the internal time of the watch is matched with the reference time and the display time is matched with the internal time of the watch, and the three hands 26*b* to 26*d* are rotated based on the display time information.

Next, the watch-side controller 23 starts to rotate the group of hands 26*b* to 26*e* again (Step ST215). In this case, the watch-side controller 23 starts to time the internal time of the watch again, and starts to rotate the group of hands 26*b* to 26*e* again with the motor drive circuit 23*b* and the driving mechanism unit 25 based on the internal time of the watch.

Next, the watch-side controller 23 transmits a display time correction completion notification to the terminal equipment 3 (Step ST216). At this point, display time correction of the analog electronic watch 2 is completed and the group of hands 26*b* to 26*e* are started to be rotated again, so that the watch-side controller 23 outputs the display time correction completion notification as a trigger for quitting the application to the terminal-side controller 35 through the watch-side communication unit 22 and the terminal-side communication unit 34 to quit the application.

Next, as illustrated in FIG. 8, the terminal-side controller 35 determines whether the display time correction completion notification is received (Step ST326).

Next, if it is determined that the display time correction completion notification is received (Yes at Step ST326), the terminal-side controller 35 quits the application (Step ST327). In this case, when receiving the display time correction completion notification, for example, the terminal-side controller 35 displays, on the display surface 32*a*, a caution to cause the user to recognize the fact that display time correction is completed, and quits the application. If it is determined that the display time correction completion notification is not received (No at Step ST326), the terminal-side controller 35 repeatedly performs Step ST326 until the display time correction completion notification is received.

If it is determined that the current display positions cannot be detected based on the image P of the hands and the dial plate (No at Step ST318), the terminal-side controller 35 displays re-imaging information on the display surface 32*a* (Step ST328). In this case, in a case of determining that the detection of the current display positions based on the reflection region is difficult, the terminal-side controller 35 displays, on the touch panel unit 32 of the terminal equipment 3, correction difficulty information indicating that the detection of the current display positions is difficult. If it can be determined that an area of the reflection region with respect to the wind shield WS is an area which makes it difficult to detect the three hands 26*b* to 26*d*, the terminal-side controller 35 according to the present embodiment provides a caution to the user to perform imaging again in a state in which the area of the reflection region with respect to the wind shield WS is reduced because the detection of the current display positions is difficult in the current image P of the hands and the dial plate. As illustrated in FIG. 11, the terminal-side controller 35 displays, on the display surface 32*a*, correction difficulty information PM1 such as "PHOTOGRAPH WITHOUT REFLECTION" as the re-imaging information. Due to this, the user can recognize the fact that the display time cannot be corrected based on the image P of the hands and the dial plate taken by himself/herself. Specifically, by displaying the information about reflection on the display surface 32*a* as the correction difficulty information PM1, the user can recognize the fact that the display time cannot be corrected because of reflection. Accordingly, the user can image the analog electronic watch 2 again by the imaging unit 31 of the terminal equipment 3 in consideration of reflection, and can securely correct the display time.

If it is determined that all of the attention points A to D cannot be extracted (No at Step ST321), the terminal-side controller 35 displays the re-imaging information on the display surface 32*a* (Step ST328). In this case, for example, if the image P of the hands and the dial plate does not include all of the attention points A to D of the analog electronic watch 2 because the analog electronic watch 2 does not face the imaging unit 31 or because all of the attention points A to D of the analog electronic watch 2 are not included in an imaging range of the imaging unit 31, the detection of the current display positions is difficult, so that the terminal-side controller 35 provides a caution to perform imaging again to cause the generated image P of the hands and the dial plate to include all of the attention points A to D of the analog electronic watch 2.

If it is determined that the current display positions cannot be detected (No at Step ST323), the terminal-side controller 35 requests temporal hand movement (Step ST329). In this case, in a case in which the current display positions cannot be detected based on the generated image P of the hands and the dial plate, it can be considered that the current display positions cannot be detected because the three hands 26*b* to 26*d* are overlapping with each other, so that the terminal-side controller 35 slightly rotates any of the three hands 26*b* to 26*d*, that is, performs temporal hand movement. The terminal-side controller 35 according to the present embodiment is used for putting the second hand 26*b* forward by 15 seconds, and outputs, to the watch-side controller 23, a temporal hand movement request signal for rotating the second hand 26*b* by 15 seconds through the terminal-side communication unit 34 and the watch-side communication unit 22.

As illustrated in FIG. 9, if it is determined that the display time information is not received (No at Step ST213), the watch-side controller 23 determines whether the temporal hand movement request is made (Step ST217). In this case, the watch-side controller 23 determines whether the terminal equipment 3 made a request for temporal hand movement to temporarily move the three hands 26*b* to 26*d* because the current display positions cannot be detected.

Next, if it is determined that the temporal hand movement request is made (Yes at Step ST217), the watch-side controller 23 stops rotating the hands after the temporal hand movement (Step ST218). In this case, in the watch-side controller 23, the motor drive circuit 23*b* outputs a drive signal to the step motor 25*a* of the driving mechanism unit 25 to rotate the second hand 26*b* by 15 seconds, and the motor drive circuit 23*b* is caused to stop outputting the drive signal to the driving mechanism unit 25. If it is determined that the temporal hand movement request is not made (No at Step ST217), the watch-side controller 23 determines whether the display time information is received (Step ST213), and repeatedly performs Step ST213 and the following steps. If it is determined that the temporal hand movement request is not made (No at Step ST217), and when a predetermined time has elapsed, the watch-side controller 23 may start to rotate the group of hands 26*b* to 26*e* again to end the control.

Next, the terminal-side controller 35 displays the re-imaging information on the display surface 32*a* (Step ST328). In this case, even when temporal hand movement of the analog electronic watch 2 is performed, there may be a case in which the user does not notice that re-imaging is required, or a case in which the user does not grasp a timing for re-imaging even though the user notices that re-imaging is required, so that the terminal-side controller 35 provides a caution to perform re-imaging after the temporal hand movement.

As described above, the analog electronic watch 2 according to the present embodiment detects the current display positions of the second hand 26*b*, the minute hand 26*c*, and the hour hand 26*d* with respect to the dial plate 26*a* in the image P of the hands and the dial plate based on the hand identification information in performing display time correction, so that detection accuracy for the current display positions of the hands in the image P of the hands and the dial plate can be improved as compared with a case of detecting the current display positions of the second hand 26*b*, the minute hand 26*c*, and the hour hand 26*d* with respect to the dial plate 26*a* without the hand identification information. Due to this, current display time information can be generated with high accuracy, so that the display time correction can be performed with high accuracy. Additionally, the current display positions of the second hand 26*b*, the minute hand 26*c*, and the hour hand 26*d* can be easily detected in the image P of the hands and the dial plate, so that the display time correction can be prevented from not being performed. Due to this, the analog electronic watch 2 according to the present embodiment can improve reliability of the display time correction. Specifically, in a case of an exterior of a wristwatch, a design and a type of the dial plate 26*a*, the hands 26*b* to 26*c*, the exterior case 29, and the operation unit 27 are widely varied, so that reliability of the display time correction can be improved by detecting the current display positions under an identification condition corresponding to each individual design as in the present embodiment.

The analog electronic watch 2 according to the present embodiment determines whether the current display positions can be detected based on the reflection region, and detects the current display positions only when determining that the current display positions can be detected based on the reflection region, so that the analog electronic watch 2 can determine that the current display positions cannot be detected due to the reflection region before detecting the current display positions based on the hand identification information. The analog electronic watch 2 according to the present embodiment can quickly determine whether the current display positions can be detected, and can cause the user to recognize the determination.

The analog electronic watch 2 according to the present embodiment detects the current display positions based on the area of the reflection region with respect to the analog electronic watch 2, so that a possibility of detecting the current display positions is reduced in proportion to increase in the area of the reflection region. Accordingly, the analog electronic watch 2 can determine whether the current display positions can be easily detected.

Figure 12:
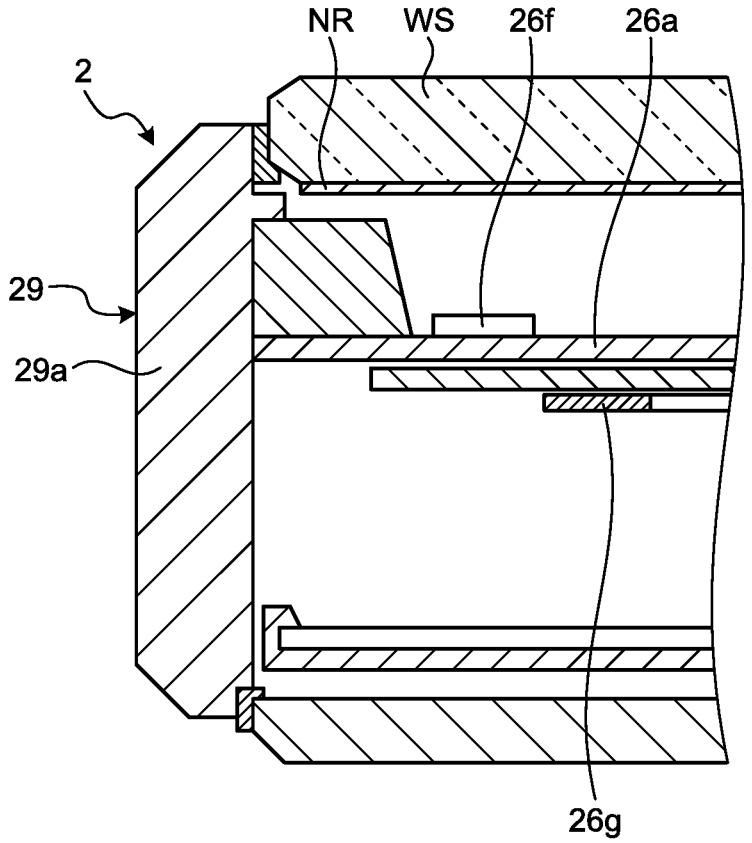
FIG. 12 is a diagram illustrating a cross section of a principal part of the analog electronic watch according to a modification.

The analog electronic watch 2 according to the present embodiment may suppress reflection of disturbance light. FIG. 12 is a diagram illustrating a cross section of a principal part of the analog electronic watch according to a modification. In the analog electronic watch 2 according to the modification, a reflection reducing coating layer NR is formed on one of surfaces opposed to each other in the vertical direction of the wind shield WS, the surface opposed to the dial plate 26*a*, that is, a lower surface. For example, the reflection reducing coating layer NR is formed by laminating a silicone compound, magnesium fluoride, and the like. The analog electronic watch system 1 according to the modification can reduce reflection at the time of imaging performed by the terminal equipment 3 because the reflection reducing coating layer NR is formed, so that the reflection region in the image P of the hands and the dial plate can be reduced. Due to this, the analog electronic watch system 1 according to the present embodiment can further improve reliability of the display time correction. In this case, the reflection reducing coating layer NR is formed on the lower surface of the wind shield WS, but may be formed on the other one of the surfaces opposed to the lower surface in the vertical direction, the surface opposed to the outside of the analog electronic watch 2, that is, an upper surface. In this case, reflection at the time of imaging performed by the terminal equipment 3 can be further reduced, so that the reflection region in the image P of the hands and the dial plate can be further reduced. The reflection reducing coating layer NR may be formed only on the upper surface of the wind shield WS.

The analog electronic watch system 1 according to the present embodiment uses the lugs 29*a* to 29*d* to specify the center O of the watch and the orientation of the watch, but the embodiment is not limited thereto. Any portion of the exterior case 29 may be used so long as the center O of the watch and the orientation of the watch can be specified. For example, the operation unit 27 or the indexes 26*f* included in the dial plate 26*a* may be used.

Second Embodiment

Figure 13:
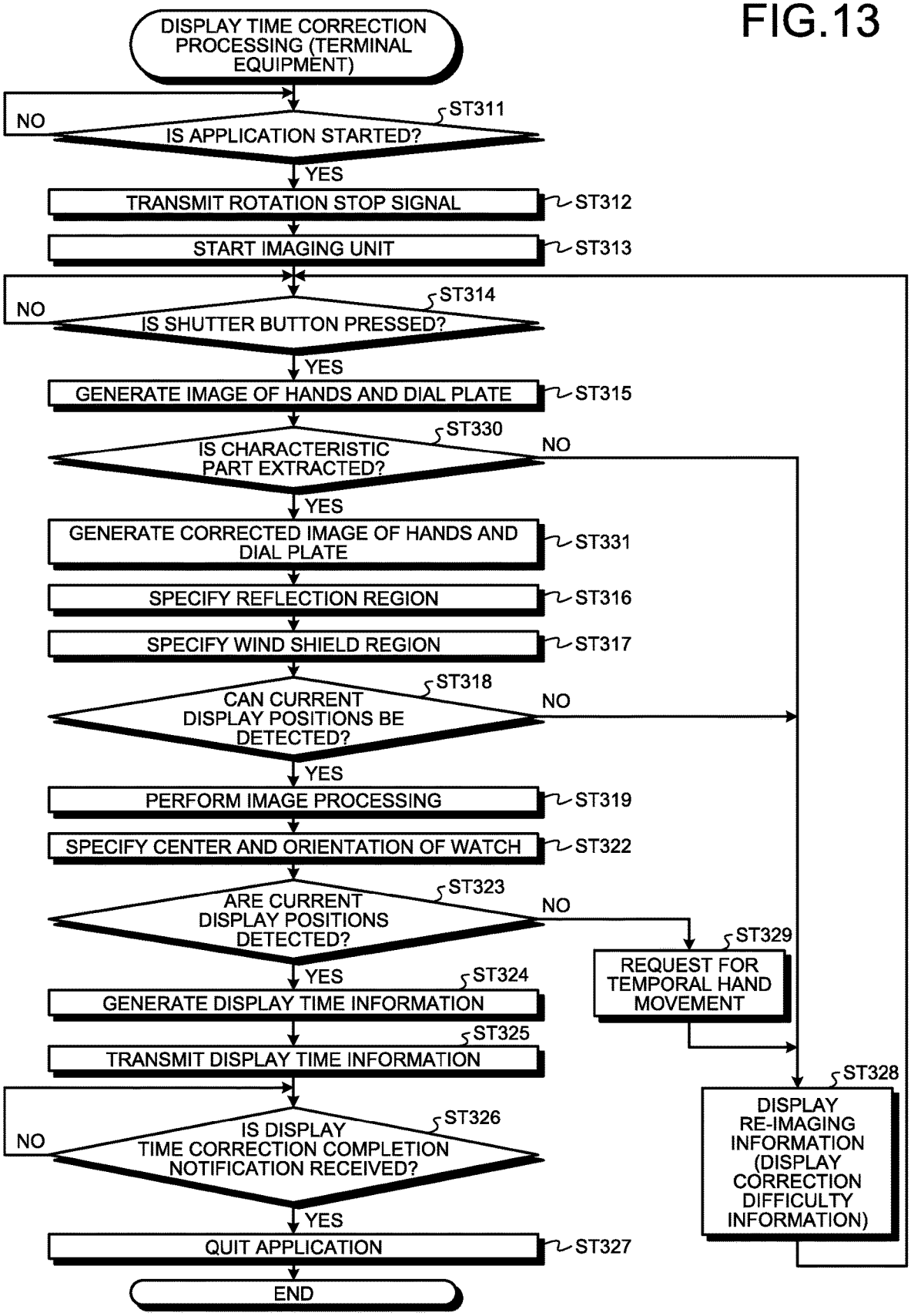
FIG. 13 is a flowchart of display time correction processing performed by terminal equipment according to a second embodiment.
Figure 14:
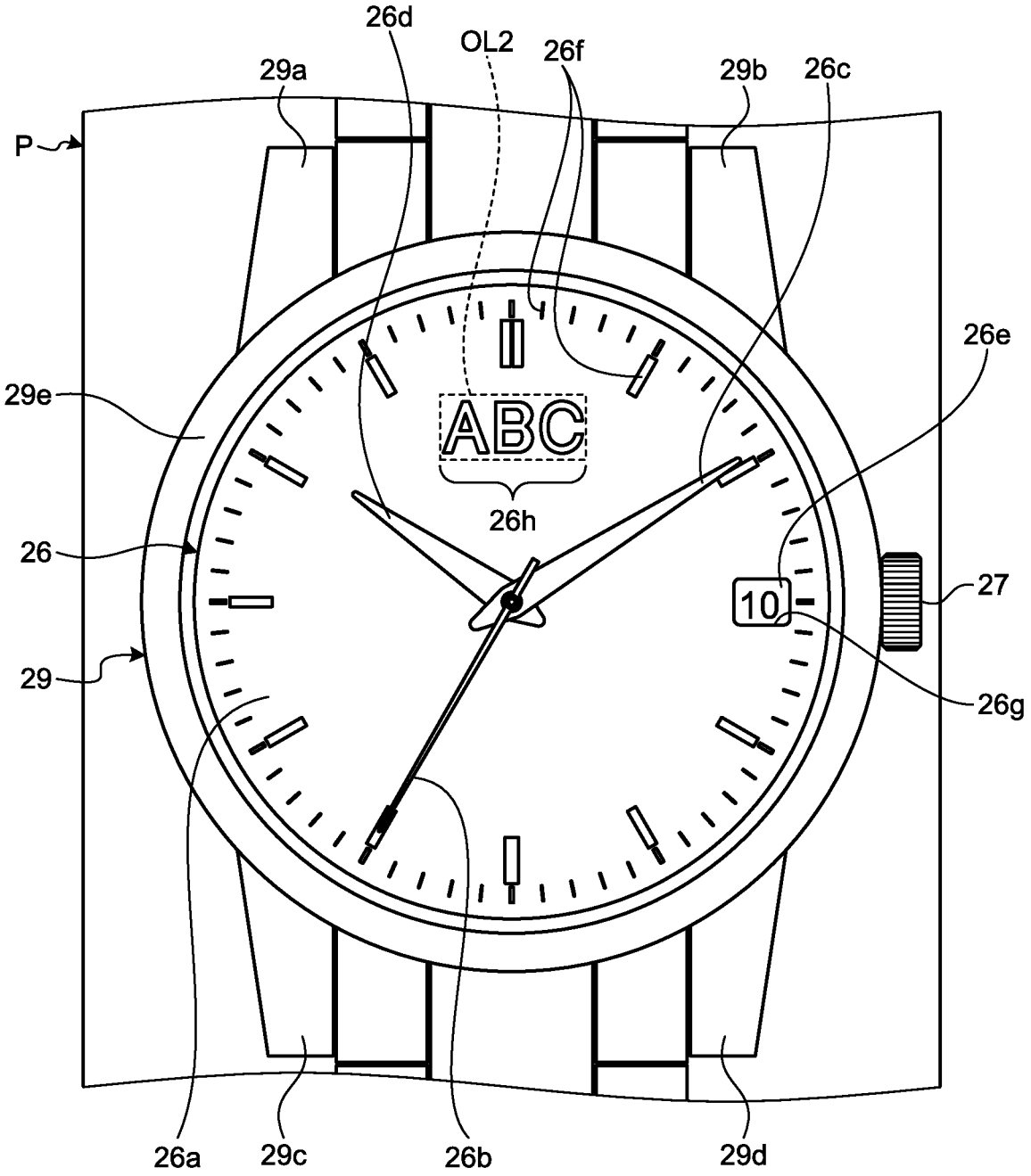
FIG. 14 is a diagram illustrating a corrected image of the hands and the dial plate taken by the terminal equipment.
Figure 15:
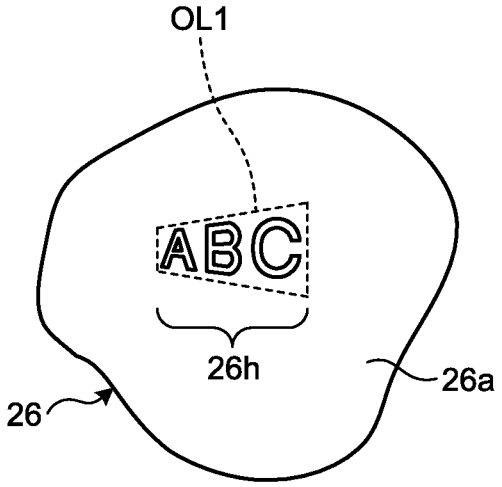
FIG. 15 is a diagram illustrating part of the image of the hands and the dial plate taken by the terminal equipment.

Next, the following describes an analog electronic watch system according to a second embodiment. FIG. 13 is a flowchart of display time correction processing performed by the terminal equipment according to the second embodiment. FIG. 14 is a diagram illustrating a corrected image of the hands and the dial plate taken by the terminal equipment. FIG. 15 is a diagram illustrating part of the image of the hands and the dial plate taken by the terminal equipment.

The analog electronic watch system according to the second embodiment is different from the analog electronic watch system 1 according to the first embodiment in that, in a case in which the dial plate 26*a* is imaged in an inclined state at the time of imaging and the dial plate 26*a* in the image P of the hands and the dial plate is inclined, the inclination is corrected, and the current display positions are detected based on a corrected image P' of the hands and the dial plate. Description about part of a basic configuration of the analog electronic watch system according to the second embodiment that is the same as the basic configuration of the analog electronic watch system 1 according to the first embodiment will not be repeated.

The dial plate 26*a* according to the present embodiment includes a characteristic part formed thereon. The characteristic part is a part with which two or more intersecting virtual lines can be formed based on a boundary with respect to the dial plate 26*a*. With the characteristic part according to the present embodiment, a quadrangular shape OL (OL1, OL2) can be formed with intersecting virtual lines based on the boundary between the characteristic part and the dial plate 26*a*. In this case, as illustrated in FIG. 14, the characteristic part is a logotype 26*h*.

The terminal-side communication unit 34 according to the present embodiment receives hand identification information including characteristic part shape information from the external server 200. The characteristic part shape information is information about the shape of the characteristic part on the dial plate 26*a*.

The terminal-side controller 35 according to the present embodiment acquires the hand identification information including the characteristic part shape information to be stored in the terminal-side storage unit 37. The terminal-side controller 35 corrects inclination of the dial plate 26*a* in the image P of the hands and the dial plate generated by the imaging unit 31 based on the characteristic part shape information included in the hand identification information, and generates the corrected image P' of the hands and the dial plate obtained by correcting inclination of the dial plate 26*a* in the image P of the hands and the dial plate. The terminal-side controller 35 performs image processing on the corrected image P' of the hands and the dial plate, and detects the current display positions of the group of hands 26*b* to 26*e* based on the hand identification information.

Next, the following describes display time correction performed by the analog electronic watch system according to the second embodiment. Description about part of the display time correction performed by the analog electronic watch system according to the second embodiment that is the same as the display time correction performed by the analog electronic watch system 1 according to the first embodiment will not be repeated.

As illustrated in FIG. 13, if it is determined that the application is started (Yes at Step ST311), the terminal-side controller 35 of the terminal equipment 3 transmits a rotation stop signal to the analog electronic watch 2 (Step ST312). Next, as illustrated in FIG. 9, if it is determined that the rotation stop signal is received (Yes at Step ST211), the watch-side controller 23 of the analog electronic watch 2 stops rotation of the group of hands 26*b* to 26*e* (Step ST212). Next, as illustrated in FIG. 13, the terminal-side controller 35 starts the imaging unit (Step ST313). If it is determined that the shutter button is pressed (Yes at Step ST314), the terminal-side controller 35 generates the image P of the hands and the dial plate (Step ST315).

Next, the terminal-side controller 35 determines whether the characteristic part is extracted (Step ST330). In this case, the terminal-side controller 35 determines whether the characteristic part, the logotype 26*h* herein, is extracted from the dial plate 26*a* in the image P of the hands and the dial plate. For example, the terminal-side controller 35 extracts a plurality of boundary points between the logotype 26*h* and the dial plate 26*a* on the dial plate 26*a* in the image P of the hands and the dial plate. Next, the terminal-side controller 35 forms a plurality of virtual lines based on the extracted boundary points. Next, the terminal-side controller 35 extracts four lines positioned on the outermost side of the logotype 26*h* and intersecting with the outermost virtual line from among the virtual lines. The terminal-side controller 35 forms the quadrangular shape OL1 with the extracted four virtual lines. When the dial plate 26*a* is imaged in an inclined state at the time of imaging, as illustrated in FIG. 15, the quadrangular shape OL1 formed with the extracted four virtual lines becomes a trapezoidal shape and the like, not a rectangular shape.

Next, as illustrated in FIG. 13, if it is determined that the characteristic part is extracted (Yes at Step ST330), the terminal-side controller 35 generates the corrected image P' of the hands and the dial plate (Step ST331). In this case, for example, the terminal-side controller 35 performs trapezoid correction based on the characteristic part shape information included in the hand identification information and the quadrangular shape OL1. In this case, as illustrated in FIG. 14, the terminal-side controller 35 compares the quadrangular shape OL2 formed with the four virtual lines based on the characteristic part shape information with the quadrangular shape OL1 in the image P of the hands and the dial plate, corrects the entire image P of the hands and the dial plate so that the quadrangular shape OL2 can be deformed to be the quadrangular shape OL1 based on a length and the like of each corresponding straight line, and generates the corrected image P' of the hands and the dial plate. That is, the generated corrected image P' of the hands and the dial plate is the image P of the hands and the dial plate in a case of imaging the dial plate 26*a* while correcting inclination thereof, that is, while facing the dial plate 26*a*.

Next, the terminal-side controller 35 specifies the reflection region (Step ST316), and specifies the wind shield region (Step ST317). If it is determined that the current display positions can be detected based on the corrected image P' of the hands and the dial plate (Yes at Step ST318), the terminal-side controller 35 performs image processing on the corrected image P' of the hands and the dial plate (Step ST319).

Next, the terminal-side controller 35 specifies the center and orientation of the watch (Step ST322). In this case, the terminal-side controller 35 specifies the center O of the watch and the orientation of the watch for the analog electronic watch 2 based on the characteristic part in the corrected image P' of the hands and the dial plate. For example, the terminal-side controller 35 specifies the center O of the watch and the orientation of the watch based on the position and orientation of the logotype 26*h* with respect to the dial plate 26*a*.

Next, if it is determined that the current display positions are detected (Yes at Step ST323), the terminal-side controller 35 generates display time information (Step ST324), and transmits the display time information to the analog electronic watch 2 (Step ST325).

If it is determined that the characteristic part cannot be extracted (No at Step ST330), the terminal-side controller 35 displays re-imaging information on the display surface 32*a* (Step ST328). In this case, for example, if the image P of the hands and the dial plate does not include the characteristic part because the analog electronic watch 2 is inclined with respect to the imaging unit 31 to a degree that the characteristic part cannot be extracted, the detection of the current display positions is difficult, so that the terminal-side controller 35 provides a caution to perform imaging again to cause the generated image P of the hands and the dial plate to include the characteristic part of the analog electronic watch 2.

As described above, the analog electronic watch 2 according to the present embodiment detects the current display positions of the second hand 26*b*, the minute hand 26*c*, and the hour hand 26*d* with respect to the dial plate 26*a* based on the corrected image P' of the hands and the dial plate obtained by correcting inclination based on the image P of the hands and the dial plate, so that detection accuracy for the current display positions of the hands in the corrected image P' of the hands and the dial plate can be further improved.

The characteristic part of the analog electronic watch system 1 according to the present embodiment is the logotype 26*h* formed on the dial plate 26*a*, but the embodiment is not limited thereto. The characteristic part may be a mark, the date window 26*g*, or the indexes 26*f* formed on the dial plate 26*a*. The number of characteristic parts used for generating the corrected image P' of the hands and the dial plate based on the image P of the hands and the dial plate is not limited to one, and may be plural.

The analog electronic watch system 1 according to the present embodiment determines whether the current display positions can be detected based on the area of the reflection region with respect to the analog electronic watch 2, but the embodiment is not limited thereto. The terminal-side controller 35 may determine whether the current display positions can be detected based on the position of the reflection region with respect to the analog electronic watch 2, that is, the position of the reflection region with respect to the dial plate 26*a*. In this case, if it is determined that the position of the reflection region with respect to the dial plate 26*a* is on a side of the indexes 26*f*, not on a side of the center O of the watch, the terminal-side controller 35 may determine that the current display positions cannot be detected. The terminal-side controller 35 may determine whether the current display positions can be detected based on the area and the position of the reflection region with respect to the analog electronic watch 2.

The analog electronic watch system 1 according to the present embodiment includes the shape information of the second hand 26*b*, the minute hand 26*c*, and the hour hand 26*d* as the hand identification information, but the shape information may include a partial shape of the second hand 26*b*, the minute hand 26*c*, and the hour hand 26*d*. The second hand 26*b*, the minute hand 26*c*, and the hour hand 26*d* overlap with each other in the vertical direction at the center O of the watch. Thus, in detecting the current display positions by performing pattern matching processing by the terminal-side controller 35, overlapping portions are hardly matched in a case of detecting the current display positions using the shape information of all of the second hand 26*b*, the minute hand 26*c*, and the hour hand 26*d*. Thus, for example, as the shape information of each of the second hand 26*b*, the minute hand 26*c*, and the hour hand 26*d*, a shape excluding the overlapping portion of each of the three hands 26*b* to 26*d* may be caused to the shape information. Due to this, the analog electronic watch system 1 can improve detection accuracy in detecting the current display positions by performing pattern matching processing by the terminal-side controller 35. The shape information of each of the second hand 26*b*, the minute hand 26*c*, and the hour hand 26*d* may include the other one or two of the three hands 26*b* to 26*d* in the overlapping portion.

The analog electronic watch system 1 according to the present embodiment puts the second hand 26*b* forward by 15 seconds as temporal hand movement, but there is a case in which the current display positions cannot be detected by the terminal-side controller 35 even when the temporal hand movement is performed. In this case, the temporal hand movement may be performed multiple times. In a case in which the current display positions cannot be detected by the terminal-side controller 35 even when the temporal hand movement is performed multiple times, the group of hands 26*b* to 26*e* may be started to rotate again to end the control. As the temporal hand movement, the minute hand 26*c* or the hour hand 26*d* may be put forward by a predetermined time. For example, in a case of the minute hand 26*c*, the minute hand 26*c* is put forward by 15 minutes as the temporal hand movement.

The analog electronic watch system 1 according to the present embodiment may set the imaging condition of the imaging sensor 31*a* for imaging the analog electronic watch 2 by the imaging unit 31 based on the hand identification information. In this case, the terminal-side controller 35 sets the imaging condition that can reduce the reflection region in the image P of the hands and the dial plate such as exposure timing, exposure time, and white balance based on the hand identification information.

The analog electronic watch system according to the present embodiments detects the current display positions of the hands with respect to the dial plate in the image of the hands and the dial plate based on the hand identification information in performing display time correction, so that detection accuracy for the current display positions of the hands in the image of the hands and the dial plate can be improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An analog electronic watch system comprising:

an analog electronic watch that includes:

at least one hand configured to rotate on a dial plate, and a watch-side communication unit configured to be able to at least receive time information about a time and transmit watch identification information from and to an outside; and a terminal equipment that includes:

a terminal-side communication unit configured to be able to at least transmit the time information about a time and receive the watch identification information to and from the outside, an imaging unit configured to image the dial plate, and generate an image of the hand and the dial plate including an image corresponding to the hand and the dial plate, and a terminal-side controller configured to detect a current display position of the hand in the image of the hand and the dial plate, and generate display time information based on the current display position, wherein the terminal-side controller:

acquires hand identification information including at least hand shape information about a shape of the hand of the analog electronic watch based on the watch identification information, detects the current display position based on the image of the hand and the dial plate and the hand identification information, and transmits at least the display time information based on the current display position to the watch-side communication unit, wherein the analog electronic watch corrects the display position of the hand based on the display time information, and wherein the terminal-side controller:

specifies a reflection region in the image of the hand and the dial plate, and determines whether the current display position is able to be detected based on the reflection region.

2. The analog electronic watch system according to claim 1, wherein the terminal equipment acquires the hand identification information from the outside through the terminal-side communication unit when acquiring the watch identification information.

3. The analog electronic watch system according to claim 2, wherein the analog electronic watch includes a wind shield opposed to the dial plate, and a reflection reducing coating layer is formed on at least a surface of the wind shield opposed to the dial plate.

4. The analog electronic watch system according to claim 2, wherein the hand identification information includes characteristic part shape information about a shape of a characteristic part of the dial plate, and the terminal-side controller generates a corrected image of the hand and the dial plate obtained by correcting inclination of the dial plate in the image of the hand and the dial plate based on the characteristic part shape information, and detects the current display positions based on the corrected image of the hand and the dial plate and the hand identification information.

5. The analog electronic watch system according to claim 4, wherein the characteristic part is at least one of a logotype, a mark, a date window, and an index formed on the dial plate.

6. The analog electronic watch system according to claim 1, wherein the terminal-side controller determines whether the current display position is able to be detected based on at least one of a position and an area of the reflection region with respect to the analog electronic watch.

7. The analog electronic watch system according to claim 6, wherein the hand identification information includes color information about a color of the analog electronic watch for specifying the reflection region, and the terminal-side controller specifies the reflection region in the image of the hand and the dial plate based on the color information.

8. The analog electronic watch system according to claim 6, wherein when it is determined that detection of the current display position based on the reflection region is difficult, the terminal-side controller displays at least correction difficulty information about difficulty in display time correction on a display unit of the terminal equipment.

9. The analog electronic watch system according to claim 6, wherein the analog electronic watch includes a wind shield opposed to the dial plate, and a reflection reducing coating layer is formed on at least a surface of the wind shield opposed to the dial plate.

10. The analog electronic watch system according to claim 6, wherein the hand identification information includes characteristic part shape information about a shape of a characteristic part of the dial plate, and the terminal-side controller generates a corrected image of the hand and the dial plate obtained by correcting inclination of the dial plate in the image of the hand and the dial plate based on the characteristic part shape information, and detects the current display positions based on the corrected image of the hand and the dial plate and the hand identification information.

11. The analog electronic watch system according to claim 1, wherein the hand identification information includes color information about a color of the analog electronic watch for specifying the reflection region, and the terminal-side controller specifies the reflection region in the image of the hand and the dial plate based on the color information.

12. The analog electronic watch system according to claim 11, wherein when it is determined that detection of the current display position based on the reflection region is difficult, the terminal-side controller displays at least correction difficulty information about difficulty in display time correction on a display unit of the terminal equipment.

13. The analog electronic watch system according to claim 1, wherein when it is determined that detection of the current display position based on the reflection region is difficult, the terminal-side controller displays at least correction difficulty information about difficulty in display time correction on a display unit of the terminal equipment.

14. The analog electronic watch system according to claim 1, wherein the analog electronic watch includes a wind shield opposed to the dial plate, and a reflection reducing coating layer is formed on at least a surface of the wind shield opposed to the dial plate.

15. The analog electronic watch system according to claim 1, wherein the hand identification information includes characteristic part shape information about a shape of a characteristic part of the dial plate, and the terminal-side controller generates a corrected image of the hand and the dial plate obtained by correcting inclination of the dial plate in the image of the hand and the dial plate based on the characteristic part shape information, and detects the current display positions based on the corrected image of the hand and the dial plate and the hand identification information.

* * * * *